US009109175B2

(12) United States Patent
Lee et al.

(10) Patent No.: US 9,109,175 B2
(45) Date of Patent: Aug. 18, 2015

(54) ISOPRENOID BASED ALTERNATIVE DIESEL FUEL

(75) Inventors: Taek Soon Lee, Albany, CA (US); Pamela Peralta-Yahya, Atlanta, GA (US); Jay D. Keasling, Berkeley, CA (US)

(73) Assignee: The Regents of the University of California, Oakland, CA (US)

( * ) Notice: Subject to any disclaimer, the term of this patent is extended or adjusted under 35 U.S.C. 154(b) by 66 days.

(21) Appl. No.: 13/883,987

(22) PCT Filed: Nov. 8, 2011

(86) PCT No.: PCT/US2011/059784

§ 371 (c)(1), (2), (4) Date: Jul. 30, 2013

(87) PCT Pub. No.: WO2012/064740

PCT Pub. Date: May 18, 2012

(65) Prior Publication Data

US 2013/0298861 A1 Nov. 14, 2013

Related U.S. Application Data

(60) Provisional application No. 61/411,347, filed on Nov. 8, 2010.

(51) Int. Cl.

| | |
|---|---|
| ***F02B 43/00*** | (2006.01) |
| ***C10L 1/16*** | (2006.01) |
| ***C10L 1/04*** | (2006.01) |
| ***C10L 1/08*** | (2006.01) |
| ***F02B 43/04*** | (2006.01) |

(52) U.S. Cl.

CPC ..... *C10L 1/1608* (2013.01); *C10L 1/04* (2013.01); *C10L 1/08* (2013.01); *F02B 43/04* (2013.01)

(58) Field of Classification Search

CPC ..... F02B 1/04; F02D 19/08; F02D 19/081
USPC ..... 44/388, 313, 385
See application file for complete search history.

(56) References Cited

U.S. PATENT DOCUMENTS

| | | | | |
|---|---|---|---|---|
| 2008/0083158 | A1* | 4/2008 | Renninger et al. | 44/313 |
| 2009/0020090 | A1 | 1/2009 | Ryder et al. | |
| 2009/0087890 | A1 | 4/2009 | Pyle et al. | |
| 2009/0280545 | A1 | 11/2009 | Mendez et al. | |
| 2010/0267971 | A1* | 10/2010 | Ohler et al. | 549/512 |

FOREIGN PATENT DOCUMENTS

WO WO 2011/017549 A2 2/2011

OTHER PUBLICATIONS

The International Search Report and Written Opinion from PCT/US2011/059784, dated Mar. 20, 2012.

* cited by examiner

*Primary Examiner* — Lindsay Low
*Assistant Examiner* — Omar Morales
(74) *Attorney, Agent, or Firm* — Kilpatrick Townsend & Stockton LLP

(57) ABSTRACT

Fuel compositions are provided comprising a hydrogenation product of a monocyclic sesquiterpene (e.g., hydrogenated bisabolene) and a fuel additive. Methods of making and using the fuel compositions are also disclosed.

FIG. 1

α-Zingiberene

-continued
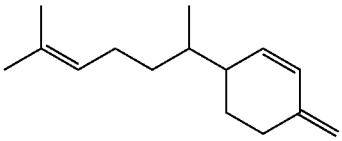
β-sesquiphellandrene
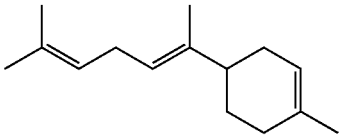
(E)-α-bisabolene
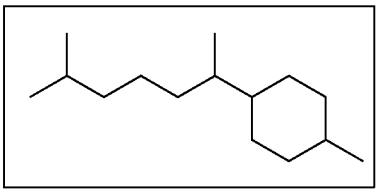
bisabolane
-continued
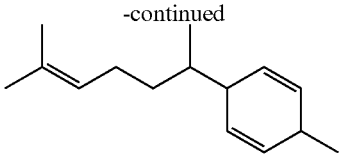
curcumene
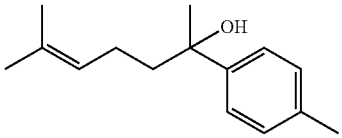
gossonorol
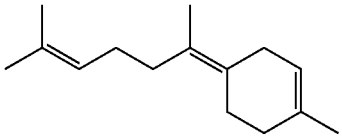
β-bisabolene
24 Claims, 11 Drawing Sheets

(a) Sesquiterpene Synthases (b) Bisabolene production in S. cerevisiae (b) Bisabolene hydrogenation product (reaction in a dodecane solution, 25 mM)

Two peaks (3:1 ratio) with identical MS (bisabolane)

ISOPRENOID BASED ALTERNATIVE DIESEL FUEL

CROSS-REFERENCES TO RELATED APPLICATIONS

This application is the U.S. National Stage of International Application No. PCT/US2011/059784, filed Nov. 8, 2011, which claims the benefit of U.S. provisional application no. 61/411,347, filed Nov. 8, 2010, each of which application is herein incorporated by reference.

STATEMENT AS TO RIGHTS TO INVENTIONS MADE UNDER FEDERALLY SPONSORED RESEARCH AND DEVELOPMENT

The invention described and claimed herein was made utilizing funds supplied by the U.S. Department of Energy under Contract No. DE-AC02-05CH11231. The government has certain rights in this invention.

BACKGROUND OF THE INVENTION

Petroleum derived fuels have been the primary source of energy for over a hundred years. Petroleum, however, has formed over millions of years in nature and is not a renewable source of energy. Currently, gasoline and diesel fuels are the two major transportation fuels. Gasoline is a complex mixture of hydrocarbons and additives for improving fuel performance. The carbon number of hydrocarbons in gasoline varies from 4 to 12, with branched alkanes, cyclic alkanes and aromatics being the most abundant. Diesel fuel is a mixture of many different hydrocarbons with the carbon numbers ranging from 9 to 23, with an average of 15-16. Usually, n-alkanes and oxygenates in diesel fuel tend to increase the octane number, while branched or unsaturated hydrocarbons lower this value.

A significant amount of research in alternative fuels has been ongoing for decades. Within this field, ethanol has been studied extensively as a gasoline substitute, and the desire to use ethanol as a transportation fuel has been increasing recently (Gray et al., *Curr. Opin. Chem. Biol.* 10:141 (2006)). However, the efficiency of ethanol as a fuel is still in debate (Pimentel, *Natural Resources Research* 14:65 (2005)); Farrell et al., *Science* 311:506 (2006)). As such, there is great interest in developing alternative fuel molecules to ethanol, which can be produced biosynthetically, and to develop the biosynthetic pathways for enhanced production of these alternative fuel molecules using synthetic biology.

Biologically produced fuels ("biofuels") have received considerable attention over the past few decades due to concerns over rising oil prices, impending supply constraints, and increasing global carbon dioxide emissions. In contrast to nonrenewable natural energy sources such as petroleum and coal, biofuels are derived from renewable natural sources, typically living organisms and their metabolic byproducts. As such, there is great interest in developing biofuels that can be made using reliable and reproducible methods, and that can be used in internal combustion engines such as diesel engines and jet engines. Quite surprisingly, the present invention provides such biofuels.

BRIEF SUMMARY OF THE INVENTION

It has surprisingly been found that when the monocyclic sesquiterpenes, which are illustrated in FIG. 1(*b*), are hydrogenated, the resulting hydrogenation products, which may be, e.g., a diastereomeric mixture of bisabolane, are very useful as a diesel fuel or a jet fuel alternative. Such hydrogenation products of the monocyclic sesquiterpenes are useful as alternative fuels not only because their carbon length meets the fuel range, but also because their branching and cyclic structures improves their cold weather properties, which is critical with diesel or jet fuels. Moreover, sesquiterpenes are typically not toxic to the producing organism, especially *E. coli*, and the relatively easy phase separation of the greasy sesquiterpene from the resulting culture media results in the production of the desired sesquiterpene in high titer.

Bisabolene, zingiberene, curcumene, and the like are sesquiterpene compounds that share a common branched cyclohexene structure. As noted, it has been surprisingly found that the hydrogenation products of these sesquiterpenes, which hydrogenation products include bisabolane (or 1(1,5-dimethylhexyl)-4-methylcyclohexane), have fuel properties comparable to commercial diesel fuels and, therefore, can advantageously be used as an alternative to diesel fuel and jet fuel as well. In addition, the hydrogenation products of such monocyclic sesquiterpenes do not have any oxygen in the molecule and, thus, they can be transported using current pipeline infrastructure without any problems. Moreover, the hydrogenation products of such monocyclic sesquiterpenes have branching methyl and cyclic structures that improve the cold weather properties of this alternative biodiesel fuel.

As such, in one aspect, the present invention provides a fuel composition, the fuel composition comprising: (a) a hydrogenation product of a monocyclic sesquiterpene; and (b) a fuel additive. In one embodiment, the monocyclic sesquiterpene includes, but is not limited to, α-zingiberene, β-sesquiphellandrene, α-bisabolene, β-bisabolene, γ-bisabolene, curcumene, gossonorol and mixtures thereof. In a preferred embodiment, the monocyclic sesquiterpene is α-bisabolene. In another preferred embodiment, the monocyclic sesquiterpene is α-zingiberene. In yet another preferred embodiment, the monocyclic sesquiterpene is a mixture of α-bisabolene and α-zingiberene. Other monocyclic sesquiterpenes suitable for use in forming the hydrogenation products of the present include those set forth in FIG. 1.

In one embodiment, the fuel additive that is mixed with the hydrogenation product of the monocyclic sesquiterpene is a chemical compound or component added to the fuel composition to alter the property of the fuel, e.g., to improve engine performance, fuel handling, fuel stability, or for contaminant control, etc. The nature and amount of the one or more additives depends on the desired use of the final fuel composition. Some nonlimiting examples of conventional fuel additives include antioxidants, thermal stability improvers, cetane improvers, stabilizers, cold flow improvers, combustion improvers, anti-foams, anti-haze additives, corrosion inhibitors, lubricity improvers, icing inhibitors, injector cleanliness additives, smoke suppressants, drag reducing additives, metal deactivators, dispersants, detergents, demulsifiers, dyes, markers, static dissipaters, biocides, and combinations thereof.

In some embodiments, the fuel composition of the present invention may further comprise a conventional fuel component derived from petroleum, coal, wood, or any other hydrocarbon source. Nonlimiting examples of conventional fuel components include, but are not limited to, diesel fuels, jet fuels, kerosene, gasoline, and Fischer-Tropsch derived fuels. In some embodiments, the conventional fuel component is derived from petroleum or coal. In certain embodiments, the fuel component is or comprises a diesel fuel, a jet fuel, kerosene, gasoline, or a combination thereof. In other embodiments, the fuel component is or comprises a distillate diesel fuel.

In certain embodiments, the fuel composition of the present invention is intended for use in diesel engines. In other embodiments, the fuel composition of the present invention is intended for use in jet engines. As such, the fuel compositions disclosed herein can be used as a fuel for internal combustion engines such as gasoline engines, diesel engines, and jet engines.

In another aspect, the present invention provides a fuel component, the fuel component comprising hydrogenated bisabolene. In yet another aspect, the present invention provides a fuel composition, the fuel composition comprising: (a) a bisabolane compound of Formula I:

(I)

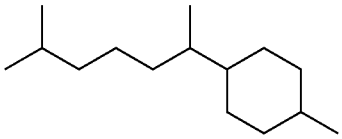

and stereoisomers thereof; and (b) a fuel additive.

In another aspect, the present invention provides a method of making a fuel composition, the method comprising adding a fuel additive to a hydrogenation product of a monocyclic sesquiterpene. In another aspect, the present invention provides a method of making a fuel component, the method comprising: hydrogenating a monocyclic sesquiterpene. In one embodiment, the fuel component is hydrogenated bisabolene.

In another aspect, the present invention provides a genetically modified host cell that produces farnesyl diphosphate via a mevalonate pathway, wherein the genetically modified host cell comprises a heterologous nucleic acid comprising a nucleotide sequence encoding bisabolene synthase. In one embodiment, the nucleotide sequence encoding bisabolene synthase is from *Abies grandis*. In one embodiment, the host cell is *Saccharomyces cerevisiae*. In another embodiment, the host cell is *Escherichia coli*. In one embodiment, the nucleotide sequence encoding bisabolene synthase gene is codon optimized for expression in *Escherichia coli*.

In yet another aspect, the present invention provides a vehicle comprising an internal combustion engine, a fuel tank connected to the internal combustion engine, and a fuel composition in the fuel tank, wherein the fuel composition is the fuel composition as disclosed herein (e.g., hydrogenated bisabolene), wherein the fuel combustion is used to power the internal combustion engine. In one embodiment, the internal combustion engine is a diesel engine. In another embodiment, the internal combustion engine is a jet engine.

In a further aspect, the present invention provides a method of powering an engine comprising the step of combusting a fuel composition of the present invention in the engine. In one embodiment, the engine is a diesel engine. In another embodiment, the engine is a jet engine.

Other objects, features, and advantages of the present invention will be apparent to one of skill in the art from the following detailed description and figures.

BRIEF DESCRIPTION OF THE DRAWINGS

FIG. 2(*b*) illustrates bisabolene production in *S. cerevisiae*. "ADS" refers to amorphadiene synthase, "BiS" refers to bisabolene synthase from plant, "BiSopt" refers to bisabolene synthase, codon optimized for *E. coli* codon usage, "SD" refers to synthetic defined media, and "YPD" refers to Yeast-extract Peptone Dextrose.

FIG. 3(*b*) provides gas chromatography/mass spectrometry (GC/MS) data for of biosynthetic bisabolene. Top: GC of biosynthetic bisabolene (RT: 8.9) showing a single product, α-bisabolene. Bottom: MS of biosynthetic bisabolene. FIG. 3(*c*) provides $^{1}$H NMR data for biosynthetic bisabolene. FIG. 3(*d*) provides $^{13}$C NMR data for biosynthetic bisabolene.

FIG. 4(*b*) provides $^{1}$H NMR of hydrogenated biosynthetic bisabolene (biosynthetic bisabolanes). The lack of vinylic protons (4.6-5.9 ppm) in the $^{1}$H NMR spectra confirms the full hydrogenation of bisabolene into two geometric isomers of bisabolane. Individual peak assignment could not be performed due to the complexity of the spectrum. Inset zooms in at region from 0-1.9 ppm. FIG. 4(*c*) provides $^{13}$C NMR of hydrogenated biosynthetic bisabolene (biosynthetic bisabolanes). The lack of alkene carbons (115-140 ppm) in the spectra confirms the full hydrogenation of bisabolene into two geometric isomers of bisabolane. Two geometric isomers show two sets of peaks.

FIG. 5(*b*) provides GC/MS data confirming that the resulting product is hydrogenated bisabolene.

DEFINITIONS

Figure 1:
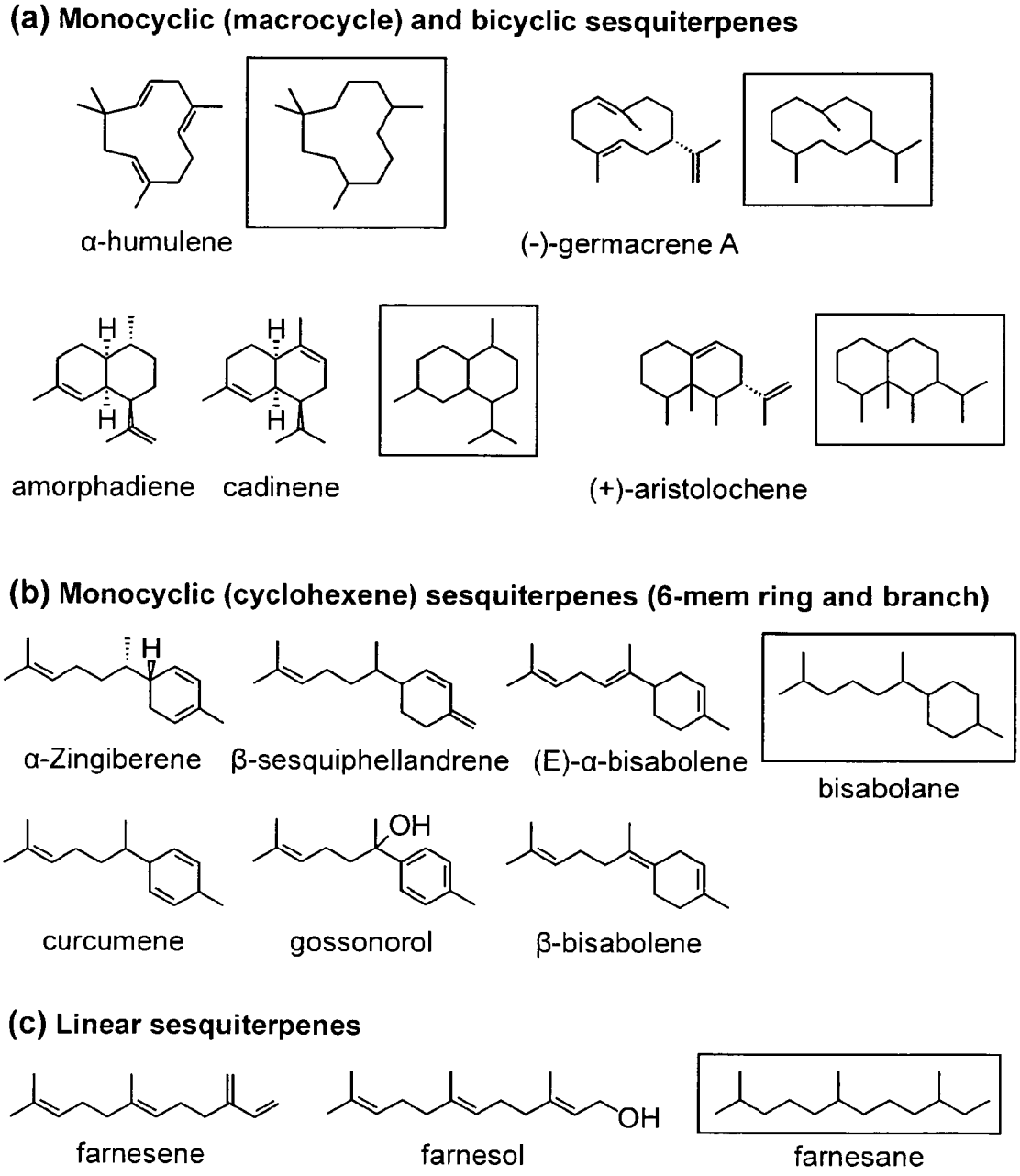
FIG. 1 illustrates the structure of various sesquiterpenes (i.e., $C_{15}$-isoprenoids). (a) Monocyclic (macrocycle) and bicyclic sesquiterpenes; (b) Monocyclic (cyclohexene) sesquiterpenes (6-member ring and branched alkenyl chain); and (c) Linear sesquiterpenes.

"Bioengineered compound" refers to a compound made by a host cell, including any archae, bacterial, or eukaryotic cells or microorganism.

"Biofuel" refers to any fuel that is derived from a biomass, i.e., a recently living organisms or their metabolic byproducts, such as manure from cows. It is a renewable energy source, unlike other natural resources such as petroleum, coal and nuclear fuels.

"Bisabolane" refers to a compound of the following formula:

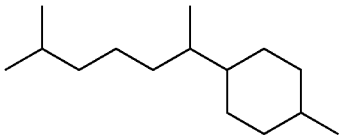

and includes the stereoisomers thereof. In some embodiments, the bisabolane comprises a substantially pure stereoisomer of bisabolane. In other embodiments, the bisabolane comprises a mixture of stereoisomers, such as enantiomers and diastereoisomers, of bisabolane. In further embodiments, the amount of each of the stereoisomers in the bisabolane mixture is independently from about 0.1 wt. % to about 99.9 wt. %, from about 0.5 wt. % to about 99.5 wt. %, from about 1 wt. % to about 99 wt. %, from about 5 wt. % to about 95 wt. %, from about 10 wt. % to about 90 wt. %, from about 20 wt. % to about 80 wt. %, based on the total weight of the bisabolane mixture.

"Bisabolene" refers to the α-bisabolene, β-bisabolene and γ-bisabolene compounds having the following formulae:

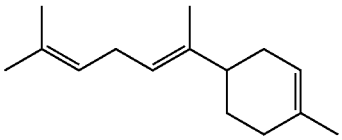

E-α-bisabolene

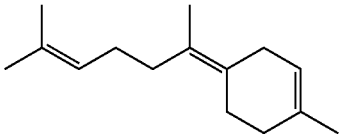

β-bisabolene

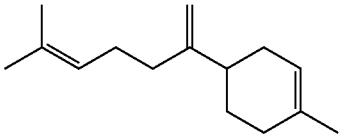

γ-bisabolene and includes the stereoisomers thereof. In some embodiments, the bisabolene comprises a substantially pure stereoisomer of bisabolene. In other embodiments, the bisabolene comprises a mixture of stereoisomers, such as enantiomers and diastereoisomers, of bisabolene. In further embodiments, the amount of each of the stereoisomers in the bisabolene mixture is independently from about 0.1 wt. % to about 99.9 wt. %, from about 0.5 wt. % to about 99.5 wt. %, from about 1 wt. % to about 99 wt. %, from about 5 wt. % to about 95 wt. %, from about 10 wt. % to about 90 wt. %, from about 20 wt. % to about 80 wt. %, based on the total weight of the bisabolene mixture.

"Hydrogenated bisabolene" refers to the hydrogenation product of α-bisabolene, β-bisabolene, γ-bisabolene or a mixture thereof.

"Cetane number" refers to a measure of how readily a fuel starts to burn (autoignite) under conditions described by ASTM D613 or ASTM D6890. A fuel with a high cetane number starts to burn shortly after it is injected into the cylinder; it has a short ignition delay period. Conversely, a fuel with a low cetane number resists autoignition and has a longer ignition delay period.

"Diesel fuel" refers to a fuel suitable for use in a diesel engine where the fuel is ignited by the heat of air under high compression. The class of diesel fuels includes hydrocarbons having a broad range of molecular weights. In some embodiments, the diesel fuels herein include hydrocarbons comprising at least 15 carbons. Types of diesel fuels include, but are not limited to, petrodiesel, biodiesel, bioengineered diesel, or mixtures thereof. Diesel fuels can also be obtained from synthetic fuels such as shale oil, or Fischer-Tropsch fuels such as those derived from synthetic gas and coal liquefaction.

"Density" refers to a measure of mass per volume at a particular temperature. The generally accepted method for measuring the density of a fuel is ASTM Standard D4052, which is incorporated herein by reference.

"Fuel" refers to one or more hydrocarbons, one or more alcohols, one or more fatty esters or a mixture thereof. Preferably, liquid hydrocarbons are used. Fuel can be used to power internal combustion engines such as reciprocating engines (e.g., gasoline engines and diesel engines), Wankel engines, jet engines, some rocket engines, missile engines and gas turbine engines. In preferred embodiments of the present invention, fuel typically comprises bisabolane or a mixture thereof as disclosed herein.

"Fuel additive" refers to chemical components added to fuels to alter the properties of the fuel, e.g., to improve engine performance, fuel handling, fuel stability, or for contaminant control. Types of additives include, but are not limited to, antioxidants, thermal stability improvers, cetane improvers, stabilizers, cold flow improvers, combustion improvers, anti-foams, anti-haze additives, corrosion inhibitors, lubricity improvers, icing inhibitors, injector cleanliness additives, smoke suppressants, drag reducing additives, metal deactivators, dispersants, detergents, demulsifiers, dyes, markers, static dissipaters, biocides and combinations thereof. The term "conventional additives" refers to fuel additives known to skilled artisan, such as those described above, and does not include bisabolane or a mixture of fuel components containing bisabolane.

"Fuel component" refers to any compound or a mixture of compounds that are used to formulate a fuel composition. There are "major fuel components" and "minor fuel components." A major fuel component is present in a fuel composition by at least 50% by volume; and a minor fuel component is present in a fuel composition by less than 50%. Fuel additives are minor fuel components. In certain embodiments, hydrogenated bisabolene or bisabolane is a major fuel component of the fuel composition of the present invention, which may be used alone, in combination with a fuel additive or in a mixture with other fuel components and/or fuel additives. Conventional fuel components refer to additional fuel components known to the skilled artisan, such as fuel components derived from petroleum, coal, wood, or any other hydrocarbon source, that can be added to the fuel compositions of the present invention, which are based on the hydrogenation products of the monocyclic sesquiterpenes, such as α-bisabolene. Illustrative examples of conventional fuel components include diesel fuels, jet fuels, kerosene, gasoline, Fischer-Tropsch derived fuels, etc.

"Fuel composition" refers to a fuel that comprises at least two fuel components, such as hydrogenated bisabolene or bisabolane and a fuel additive.

"Isoprenoid" and "isoprenoid compound" are used interchangeably herein and refer to a compound derivable from isopentenyl diphosphate. The monocyclic sesquiterpene compounds used as starting materials in making the fuel component bisabolane are $C_{15}$-isoprenoids "Monocyclic sesquiterpene starting material" or "monocyclic sesquiterpene" refers to a $C_{15}$-isoprenoid compound from which hydrogenated bisabolene or bisabolane can be made.

"Jet fuel" refers to a fuel suitable for use in a jet engine.

"Kerosene" refers to a specific fractional distillate of petroleum (also known as "crude oil"), generally between about 150° C. and about 275° C. at atmospheric pressure. Crude oils are composed primarily of hydrocarbons of the paraffinic, naphthenic, and aromatic classes.

"Missile fuel" refers to a fuel suitable for use in a missile engine.

"Petrodiesel" refers to a specific fractional distillate of petroleum, generally from between 120° C. and 380° C. at atmospheric pressure. In other embodiments, petrodiesel is a fractional distillate of petroleum from between 150° C. and 370° C. at 1 atmospheric pressure.

"Petroleum-based fuel" refers to a fuel that includes a fractional distillate of petroleum.

"Pour point" refers to an approximate indication of the lowest temperature at which a fuel can be poured or removed from containers or can be caused to flow through tubing and piping, and is measured under conditions described by ASTM D97. The pour point is one of the characteristics that determines a fuel's usefulness and serviceability in colder climates.

"Synthetic fuel" refers to any liquid fuel obtained from coal, natural gas, or biomass.

"Smoke Point" refers to the point in which a fuel or fuel composition is heated until it breaks down and smokes. The generally accepted method for measuring the smoke point of a fuel is ASTM Standard D1322, which is incorporated herein by reference.

"Viscosity" refers to a measure of the resistance of a fuel or fuel composition to deform under shear stress. The generally accepted method for measuring the viscosity of a fuel is ASTM Standard D445, which is incorporated herein by reference.

As used herein, a composition that is a "substantially pure" compound is substantially free of one or more other compounds, i.e., the composition contains greater than 80 vol. %, greater than 90 vol. %, greater than 95 vol. %, greater than 96 vol. %, greater than 97 vol. %, greater than 98 vol. %, greater than 99 vol. %, greater than 99.5 vol. %, greater than 99.6 vol. %, greater than 99.7 vol. %, greater than 99.8 vol. %, or greater than 99.9 vol. % of the compound; or less than 20 vol. %, less than 10 vol. %, less than 5 vol. %, less than 3 vol. %, less than 1 vol. %, less than 0.5 vol. %, less than 0.1 vol. %, or less than 0.01 vol. % of the one or more other compounds, based on the total volume of the composition.

As used herein, a composition that is "substantially free" of a compound means that the composition contains less than 20 vol. %, less than 10 vol. %, less than 5 vol. %, less than 4 vol. %, less than 3 vol. %, less than 2 vol. %, less than 1 vol. %, less than 0.5 vol. %, less than 0.1 vol. %, or less than 0.01 vol. % of the compound, based on the total volume of the composition.

As used herein, the term "stereochemically pure" means a composition that comprises one stereoisomer of a compound and is substantially free of other stereoisomers of that compound. For example, a stereomerically pure composition of a compound having one chiral center will be substantially free of the opposite enantiomer of the compound. A stereomerically pure composition of a compound having two chiral centers will be substantially free of other diastereomers of the compound. A typical stereomerically pure compound comprises greater than about 80% by weight of one stereoisomer of the compound and less than about 20% by weight of other stereoisomers of the compound, more preferably greater than about 90% by weight of one stereoisomer of the compound and less than about 10% by weight of the other stereoisomers of the compound, even more preferably greater than about 95% by weight of one stereoisomer of the compound and less than about 5% by weight of the other stereoisomers of the compound, and most preferably greater than about 97% by weight of one stereoisomer of the compound and less than about 3% by weight of the other stereoisomers of the compound.

As used herein, the term "enantiomerically pure" means a stereomerically pure composition of a compound having one chiral center.

As used herein, the term "racemic" or "racemate" means about 50% of one enantiomer and about 50% of the corresponding enantiomer relative to all chiral centers in the molecule. The invention encompasses all enantiomerically pure, enantiomerically enriched, diastereomerically pure, diastereomerically enriched, and racemic mixtures of the compounds of the invention.

In addition to the definitions above, certain compounds described herein, such as the monocyclic sesquiterpene starting materials, have one or more double bonds that can exist as either the Z or E isomer. In certain embodiments, compounds described herein are present as individual isomers substantially free of other isomers and alternatively, as mixtures of various isomers, e.g., racemic mixtures of stereoisomers.

"Zingiberene" refers to the α-zingiberene compound having the following formula:

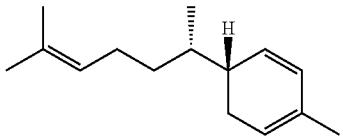

α-zingiberene and includes the stereoisomers thereof. In some embodiments, the zingiberene comprises a substantially pure stereoisomer of zingiberene. In other embodiments, the zingiberene comprises a mixture of stereoisomers, such as enantiomers and diastereoisomers, of zingiberene. In further embodiments, the amount of each of the stereoisomers in the zingiberene mixture is independently from about 0.1 wt. % to about 99.9 wt. %, from about 0.5 wt. % to about 99.5 wt. %, from about 1 wt. % to about 99 wt. %, from about 5 wt. % to about 95 wt. %, from about 10 wt. % to about 90 wt. %, from about 20 wt. % to about 80 wt. %, based on the total weight of the zingiberene mixture.

DETAILED DESCRIPTION OF THE INVENTION

I. Introduction

Sesquiterpenes are $C_{15}$-isoprenoids with three branched methyl groups. There are linear, monocyclic and bicyclic sesquiterpenes, which can be biosynthesized by various terpene synthases, i.e., sesquiterpene synthases, from farnesyl pyrophosphate ("FPP"). It has surprisingly been found that when the monocyclic sesquiterpenes, which are illustrated in FIG. 1(*b*), are hydrogenated, the resulting hydrogenation products, e.g., hydrogenated bisabolene, which may be a diastereomeric mixture of bisabolane, are very useful as a diesel fuel or a jet fuel alternative. Such monocyclic sesquiterpenes are useful as alternative fuels not only because their carbon lengths meet the fuel range, but also because their branching and cyclic structures improve their cold weather properties, which is critical with diesel or jet fuels. Moreover, sesquiterpenes are typically not toxic to the producing organism, especially *E. coli*, and the relatively easy phase separation of the greasy sesquiterpene from the resulting culture media results in the production of the desired sesquiterpene in high titer.

Bisabolene, zingiberene, curcumene, and the like are sesquiterpene compounds that share a common branched cyclohexene structure. As noted, it has been surprisingly found that the hydrogenation products of these sesquiterpenes, which hydrogenation products include bisabolane (or 1(1,5-dimethylhexyl)-4-methylcyclohexane), have fuel properties comparable to commercial diesel fuels and, therefore, can advantageously be used as an alternative to diesel fuel and jet fuel as well. For instance, hydrogenated bisabolene showed a Derived Cetane Number (DCN) of about 42, which is comparable to the Cetane Number (CN) of commercial No. 2 Diesel fuel (CN of about 42).

The current diesel fuel alternatives to petrodiesel are primarily based on biofuels that are methyl or ethyl esters of fatty acids derived from chemical hydrolysis of vegetable oils. Such biodiesels cannot be transported using current pipeline infrastructure due to their corrosivity, which, in addition to the short supply of vegetable oil, is one of the major disadvantages of using fatty acid methyl ester (FAME) biodiesel. However, the bisabolane biodiesel of the present invention, which is the hydrogenation product of, e.g., bisabolene, zingiberene, curcumene and mixtures thereof, does not have any oxygen in the molecule and, thus, it can be transported using current pipeline infrastructure without any problems. Moreover, the bisabolane biodiesel of the present invention has branching methyl and cyclic structures that improve the cold weather properties of this alternative diesel fuel.

II. The Fuel Compositions

As such, in one aspect, the present invention provides a fuel composition comprising: (a) a hydrogenation product of a monocyclic sesquiterpene; and (b) a fuel additive. In one embodiment, the monocyclic sesquiterpene includes, but is not limited to, α-zingiberene, β-sesquiphellandrene, α-bisabolene, β-bisabolene, γ-bisabolene, curcumene, gossonorol and mixtures thereof. In a preferred embodiment, the monocyclic sesquiterpene is α-bisabolene. In another preferred embodiment, the monocyclic sesquiterpene is α-zingiberene. In yet another preferred embodiment, the monocyclic sesquiterpene is a mixture of α-bisabolene and α-zingiberene. Other monocyclic sesquiterpenes suitable for use in the present include those set forth in FIG. 1.

The hydrogenation product of the monocyclic sesquiterpenes, such as the hydrogenation product of α-bisabolene or α-zingiberene, comprises bisabolane having the following formula:

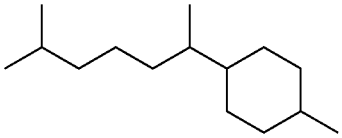

and includes the stereoisomers thereof. In some embodiments, the bisabolane comprises a substantially pure stereoisomer of bisabolane. In other embodiments, the bisabolane comprises a mixture of stereoisomers, such as a diastereomeric mixture of bisabolane. In other embodiment, the bisabolane is present in a mixture in combination with other reaction products of the hydrogenation reaction.

The amount of the hydrogenation product in the fuel composition disclosed herein may be from about 50% to about 99.999%, from about 55% to about 99%, from about 65% to about 98%, from about 75% to about 99%, from about 80% to about 99%, from about 85% to about 99% or from about 85% to about 99%, based on the total amount of the fuel composition. In certain embodiments, the amount of the hydrogenation product is more than about 50%, more than about 60%, more than about 65%, more than about 70%, more than about 75%, more than about 80%, more than about 85%, more than about 90%, more than about 95%, more than about 96%, more than about 97%, more than about 98% or more than about 99%, based on the total amount of the fuel composition. In some embodiments, the amount is in wt. % based on the total weight of the fuel composition. In other embodiments, the amount is in vol. % based on the total volume of the fuel composition.

In one embodiment, the fuel additive that is mixed with the hydrogenation product of the monocyclic sesquiterpene is a chemical compound or component added to the fuel composition to alter the property of the fuel, e.g., to improve engine performance, fuel handling, fuel stability, or for contaminant control, etc. The nature and amount of the one or more additives depend on the desired use of the final fuel composition. Some nonlimiting examples of conventional fuel additives include antioxidants, thermal stability improvers, cetane improvers, stabilizers, cold flow improvers, combustion improvers, anti-foams, anti-haze additives, corrosion inhibitors, lubricity improvers, icing inhibitors, injector cleanliness additives, smoke suppressants, drag reducing additives, metal deactivators, dispersants, detergents, demulsifiers, dyes, markers, static dissipaters, biocides, and combinations thereof.

The amount of a fuel additive in the fuel composition disclosed herein may be from about 0.1% to less than about 50%, from about 0.2% to about 40%, from about 0.3% to about 30%, from about 0.4% to about 20%, from about 0.5% to about 15% or from about 0.5% to about 10%, based on the total amount of the fuel composition. In certain embodiments, the amount of a fuel additive is less than about 50%, less than about 45%, less than about 40%, less than about 35%, less than about 30%, less than about 25%, less than about 20%, less than about 15%, less than about 10%, less than about 5%, less than about 4%, less than about 3%, less than about 2%, less than about 1% or less than about 0.5%, based on the total amount of the fuel composition. In some embodiments, the amount is in wt. % based on the total weight of the fuel composition. In other embodiments, the amount is in vol. % based on the total volume of the fuel composition.

In a preferred embodiment, the total amount of the fuel additives in the fuel composition may range from 0.001 to 10 wt %, based on the total weight of the fuel composition, and in certain embodiments from 0.01 to 5 wt %. As such, if the fuel composition is made up of only the hydrogenation product of the monocyclic sesquiterpene and the fuel additive, the hydrogenation product is present in an amount of about 90% to about 99.999% by weight or volume, based on the total weight or volume of the fuel composition.

Illustrative examples of fuel additives are described in greater detail below. Lubricity improvers are one example of an fuel additive that can be used in the fuel compositions of the present invention. Some nonlimiting examples of suitable lubricity improvers include esters of fatty acids such as glycerol monooleate and di-isodecyl adipate; amide-based additives such as those available from the Lubrizol Chemical Company (e.g., LZ 539 C); dimerised linoleic acid; aminoalkylmorpholines; dithiophosphoric diester-dialcohols;

and alkyl aromatic compounds having at least one carboxyl group. Some suitable lubricity improvers or enhancers are described in patent literature such as WO 95/33805; WO 94/17160; WO 98/01516; and U.S. Pat. Nos. 5,484,462 and 5,490,864; and in the paper by Danping Wei and H. A. Spikes, "The Lubricity of Diesel Fuels", Wear, III (1986) 217 235, all of which are incorporated herein by reference. Other nonlimiting examples of commercially available lubricity improvers include OLI 9000 (from Octel Corporation, Manchester, UK), PARADYNE™ 655 and VEKTRON™ 6010 (from Infineum, Linden, N.J.), and HITEC™ E58O (from Ethyl Corporation, Richmond, Va.). In certain embodiments, the concentration of the lubricity improver in the fuel falls in the range from about 1 ppm to about 50,000 ppm, preferably from about 10 ppm to about 20,000 ppm, and more preferably from about 25 ppm to about 10,000 ppm.

Detergents are another example of a fuel additive that can be used in the fuel compositions of the present invention. Some nonlimiting examples of suitable detergents include polyolefin substituted succinimides or succinamides of polyamines, for instance polyisobutylene succinimides or polyisobutylene amine succinamides, aliphatic amines, Mannich bases or amines, and polyolefin (e.g., polyisobutylene) maleic anhydrides. Some suitable succinimide detergents are described in GB960493, EP0147240, EP0482253, EP0613938, EP0557561, and WO 98/42808, all of which are incorporated herein by reference. In some embodiments, the detergent is a polyolefin substituted succinimide such as polyisobutylene succinimide. Some nonlimiting examples of commercially available detergent additives include F7661 and F7685 (from Infineum, Linden, N.J.) and OMA 4130D (from Octel Corporation, Manchester, UK). Typically, the amount of the detergent additive is less than 10,000 ppm, less than 1000 ppm, less than 100 ppm, or less than 10 ppm, based on the total weight of the fuel composition.

In certain other embodiments, the fuel composition includes a fuel additive that is a cetane improver. Some nonlimiting examples of cetane improvers include peroxides, nitrates, nitrites, azo compounds and the like. Alkyl nitrates such as amyl nitrate, hexyl nitrate and mixed octyl nitrates, 2-methyl-2-nitropropyl nitrate, and 2-ethylhexyl nitrate can be used. In some embodiments, the cetane improver is 2-ethylhexyl nitrate which is commercially available from the Associated Octel Company Limited under the brand name Cl-0801. The cetane improver may be present in the fuel composition at a concentration of about 0.001 to 5 wt %, based on the total weight of the fuel composition, and in certain embodiments, from about 0.01 to 2.5 wt %.

Stabilizers improve the storage stability of the fuel composition. Some nonlimiting examples of stabilizers include tertiary alkyl primary amines. Many stabilizers also act as corrosion inhibitors, The stabilizer may be present in the fuel composition at a concentration from about 0.001 wt. % to about 2 wt. %, based on the total weight of the fuel composition, and in one embodiment from about 0.01 wt. % to about 1 wt. %.

Combustion improvers increase the mass burning rate of the fuel composition. Some nonlimiting examples of combustion improvers include ferrocene(dicyclopentadienyl iron), iron-based combustion improvers (e.g., TURBOTECT™ ER-18 from Turbotect (USA) Inc., Tomball, Tex.), barium-based combustion improvers, cerium-based combustion improvers, and iron and magnesium-based combustion improvers (e.g., TURBOTECT™ 703 from Turbotect (USA) Inc., Tomball, Tex.). The combustion improver may be present in the fuel composition at a concentration from about 0.001 wt. % to about 1 wt. %, based on the total weight of the fuel composition, and in certain embodiments from about 0.01 wt. % to about 1 wt. %.

Antioxidants prevent the formation of gum depositions on fuel system components caused by oxidation of fuels in storage and/or inhibit the formation of peroxide compounds in certain fuel compositions can be used herein. The antioxidant may be present in the fuel composition at a concentration from about 0.001 wt. % to about 5 wt. %, based on the total weight of the fuel composition, and in certain embodiments from about 0.01 wt. % to about 1 wt. %.

Static dissipaters reduce the effects of static electricity generated by movement of fuel through high flow-rate fuel transfer systems. The static dissipater may be present in the fuel composition at a concentration from about 0.001 wt. % to about 5 wt. %, based on the total weight of the fuel composition, and in certain embodiments from about 0.01 wt. % to about 1 wt. %.

Corrosion inhibitors protect ferrous metals in fuel handling systems such as pipelines, and fuel storage tanks, from corrosion. In circumstances where additional lubricity is desired, corrosion inhibitors that also improve the lubricating properties of the composition can be used. The corrosion inhibitor may be present in the fuel composition at a concentration from about 0.001 wt. % to about 5 wt. %, based on the total weight of the fuel composition, and in one embodiment from about 0.01 wt. % to about 1 wt. %.

Fuel system icing inhibitors (also referred to as anti-icing additives) reduce the freezing point of water precipitated from jet fuels due to cooling at high altitudes and prevent the formation of ice crystals that restrict the flow of fuel to the engine. Certain fuel system icing inhibitors can also act as a biocide. The fuel system icing inhibitor may be present in the fuel composition at a concentration from about 0.001 wt. % to about 5 wt. %, based on the total weight of the fuel composition, and in certain embodiments from about 0.01 wt. % to about 1 wt. %.

Biocides are used to combat microbial growth in the fuel composition. The biocide may be present in the fuel composition at a concentration from about 0.001 wt. % to about 5 wt. %, based on the total weight of the fuel composition, and in certain embodiments from about 0.01 wt. % to about 1 wt. %.

Metal deactivators suppress the catalytic effect of some metals, particularly copper, have on fuel oxidation. The metal deactivator may be present in the fuel composition at a concentration from about 0.001 wt. % to about 5 wt. %, based on the total weight of the fuel composition, and in certain embodiments from about 0.01 wt. % to about 1 wt. %.

Thermal stability improvers are use to inhibit deposit formation in the high temperature areas of, e.g., the aircraft fuel system. The thermal stability improver may be present in the fuel composition at a concentration from about 0.001 wt. % to about 5 wt. %, based on the total weight of the fuel composition, and in certain embodiments from about 0.01 wt. % to about 1 wt. %.

As noted, the foregoing additives are illustrative of the types of fuel additives that are suitable for use in the fuel compositions of the present invention. Other additives known to and used by those of skill can also be used in the fuel compositions of the present invention. For instance, conventional fuel additives have been described in Chunsham Song et al., "Chemistry of Diesel Fuel," Taylor & Francis, London, Chapter 1, pp. 32-36 (2000), which is incorporated herein by reference. Further, the following U.S. Patents disclose various additives that can be used in the fuel compositions of the present invention: U.S. Pat. Nos. 7,399,323, 6,054,420; 6,051,039; 5,997,593; 5,997,592; 5,993,498; 5,968,211;

5,958,089; 5,931,977; 5,891,203; 5,882,364; 5,880,075; 5,880,072; 5,855,629; 5,853,436; 5,743,922; 5,630,852; 5,529,706; 5,505,867; 5,492,544; 5,490,864; 5,484,462; 5,321,172; and 5,284,492. The disclosures of all of the preceding U.S. patents are incorporated by reference herein in their entirety.

In some embodiments, the fuel composition of the present invention may further comprise a conventional fuel component derived from petroleum, coal, wood, or any other hydrocarbon source. Nonlimiting examples of conventional fuel components include diesel fuels, jet fuels, kerosene, gasoline, and Fischer-Tropsch derived fuels. In some embodiments, the conventional fuel component is derived from petroleum or coal. In certain embodiments, the fuel component is or comprises a diesel fuel, jet fuel, kerosene, gasoline, or a combination thereof. In other embodiments, the fuel component is or comprises a distillate diesel fuel. In further embodiments, the amount of the conventional fuel component is at least 10%, at least 10%, at least 15%, at least 20%, at least 30%, at least 40%, at least 50%, at least 60%, at least 70%, at least 80%, or at least 90%, based on the total weight or volume of the fuel composition. In still further embodiments, the amount of the conventional fuel component is at most 5%, at most 10%, at most 10%, at most 20%, at most 30%, at most 40%, at most 50%, at most 60%, at most 70%, at most 80%, or at most 90%, based on the total weight or volume of the fuel composition.

In certain embodiments, the fuel composition of the present invention is intended for use in diesel engines. In other embodiments, the fuel composition of the present invention is intended for use in jet engines.

III. Uses for the Fuel Compositions of the Present Invention

The fuel compositions of the present invention can be stored in or received by a fuel container such as a fuel tank. A fuel tank is generally a safe container for flammable liquids. In some embodiments, the fuel tank is a part of a combustion engine system in which a fuel is stored and propelled by a fuel pump or released in pressurized gas form into a combustion engine. Any fuel tank that can store or receive one or more liquid fuels can be used herein. Some nonlimiting examples of suitable fuel containers include vehicle fuel tanks such as automobile fuel tanks and aircraft fuel tanks, fuel tanks above ground or in the ground (e.g., at a fueling station), tanks on transportation vehicles such as tanker trucks, tanker trains, and tanker ships. In certain embodiments, the fuel tank may be connected to other equipments or devices such as power tools, generators and internal combustion engines.

The fuel tanks may vary in size and complexity from small plastic tanks of a butane lighter to the multi-chambered cryogenic Space Shuttle external tank. The fuel tank may be made of a plastic such as polyethylenes (e.g., HDPE and UHDPE), or a metal such as steel or aluminum.

In some embodiments, the fuel compositions of the present invention are stored in an aircraft fuel tank or a vehicle fuel tank and propelled by a fuel pump or released in pressurized gas form into an internal combustion engine to power an aircraft or a vehicle. The aircraft fuel tank or vehicle fuel tank can be an integral fuel tank, rigid removable fuel tank, a bladder fuel tank or a combination thereof.

In certain embodiments, the fuel tank is an integral tank. The integral tank is generally an area inside the aircraft or vehicle structure that have been sealed to allow fuel storage. An example of this type is the "wet wing" generally used in larger aircraft. Most large transport aircraft generally use the integral tank which stores fuel in the wings and/or tail of the airplane.

In some embodiments, the fuel tank is a rigid removable tank. The rigid removable tank is generally installed in a compartment designed to accommodate the tank. Such tanks are generally made of metal, and may be removed for inspection, replacement or repair. The aircraft or other vehicle does not rely on the tank for structural integrity. These tanks are generally found in smaller general aviation aircrafts.

In certain embodiments, the fuel tank is a bladder tank. The bladder tank is generally reinforced rubberized bags installed in a section of aircraft structure designed to accommodate the weight of the fuel. The bladder tank may be rolled up and installed into the compartment through the fuel filler neck or access panel, and may be secured by means of metal buttons or snaps inside the compartment. The bladder tank is generally found in many high-performance light aircraft and some smaller turboprops.

The fuel compositions of the present invention can be used to power any equipment such as an emergency generator or internal combustion engine, which requires a fuel such as diesel fuels, jet fuels or missile fuels. In one embodiment, the present invention provides a fuel system for providing an internal combustion engine with a fuel wherein the fuel system comprises a fuel tank containing the fuel composition disclosed herein. Optionally, the fuel system may further comprise an engine cooling system having a recirculating engine coolant, a fuel line connecting the fuel tank with the internal combustion engine and/or a fuel filter arranged on the fuel line. Some nonlimiting examples of internal combustion engines include reciprocating engines (e.g., gasoline engines and diesel engines), Wankel engines, jet engines, some rocket engines and gas turbine engines.

In some embodiments, the fuel tank is arranged with the cooling system so as to allow heat transfer from the recirculating engine coolant to the fuel composition contained in the fuel tank. In other embodiments, the fuel system further comprises a second fuel tank containing a second fuel for a jet engine and a second fuel line connecting the second fuel tank with the engine. Optionally, the first and second fuel lines can be provided with electromagnetically operated valves that can be opened or closed independently of each other or simultaneously. In further embodiments, the second fuel is a conventional fuel, such as a jet fuel (e.g., Jet A).

In another aspect, an engine arrangement is provided comprising an internal combustion engine, a fuel tank containing the fuel composition disclosed herein, a fuel line connecting the fuel tank with the internal combustion engine. Optionally, the engine arrangement may further comprise a fuel filter and/or an engine cooling system comprising a recirculating engine coolant. In some embodiments, the internal combustion engine is a diesel engine. In other embodiments, the internal combustion engine is a jet engine or some other vehicle engine.

When using the fuel compositions of the present invention, it is desirable to remove particulate matter originating from the fuel composition before injecting it into the engine. Therefore, it is desirable to select a suitable fuel filter for use in the fuel system disclosed herein. Water in fuels used in an internal combustion engine, even in small amounts, can be very harmful to the engine. Therefore, it is desirable that water present in fuel composition can be removed prior to injection into the engine. In some embodiments, water and particulate matter can be removed by the use of a fuel filter utilizing a turbine centrifuge, in which water and particulate matter are separated from the fuel composition to an extent allowing injection of the filtrated fuel composition into the engine, without risk of damage to the engine. Other types of fuel filters that can remove water and/or particulate matter may of course also be used.

Another aspect of the invention provides a vehicle comprising an internal combustion engine, a fuel tank containing a fuel composition of the present invention, a fuel line connecting the fuel tank with the internal combustion engine. Optionally, the vehicle may further comprise a fuel filter and/or an engine cooling system comprising a recirculating engine coolant. Some nonlimiting examples of vehicles include cars, trucks, motorcycles, trains, ships, and aircrafts.

In another aspect, a vehicle is provided comprising an internal combustion engine, a fuel tank containing the fuel composition disclosed herein, and a fuel line connecting the fuel tank with the internal combustion engine. Optionally, the vehicle may further comprise a fuel filter and/or an engine cooling system comprising a recirculating engine coolant. Some nonlimiting examples of vehicles include cars, trucks, motorcycles, trains, ships, and aircrafts.

IV. Methods for Making the Fuel Components Used in the Fuel Compositions of the Present Invention The fuel compositions disclosed herein can be produced in a cost-effective and environmentally friendly manner. Advantageously, the monocyclic sesquiterpene compounds used as the starting material to produce the hydrogenation products (e.g., hydrogenated bisabolene) provided herein can be produced by one or more microorganisms. These monocyclic sesquiterpene compounds can thus provide a renewable source of energy for diesel or jet fuels. Further, these monocyclic sesquiterpenes can decrease dependence on nonrenewable sources of fuel, fuel components, and/or fuel additives. In certain embodiments, the present invention encompasses a fuel composition comprising hydrogenated bisabolene or bisabolane derived from a bioengineered monocyclic sesquiterpene, such as bisabolene or zingiberene.

A. Biological Methods for Producing the Monocyclic Sesquiterpene Starting Materials

1. Host Cells

The monocyclic sesquiterpene, i.e., $C_{15}$ isoprenoid, starting material can be made by any method known in the art including biological methods, chemical syntheses (without the use of biologically derived materials), and hybrid methods wherein both biological and chemical means are used. When the monocyclic sesquiterpene starting material is made biologically, one method comprises the use of a host cell that has been modified to produce the desired product. Like all isoprenoids, the monocyclic sesquiterpene, i.e., $C_{15}$ isoprenoid, starting material is made biochemically through a common intermediate, isopentenyl diphosphate ("IPP").

The host cell can be grown according to any technique known to those of skill in the art. In particular, the host cell can be grown in culture medium appropriate for the host cell. In advantageous embodiments, the culture medium comprises readily available, renewable components. The present invention thus provides readily available, renewable sources of energy and methods of their use to produce fuel compositions. In certain embodiments, the host cell is grown or cultured by contact with a simple sugar under conditions suitable for their growth and production of a $C_{15}$ isoprenoid. In certain embodiments, the host cell can be grown or cultured by contact with glucose, galactose, mannose, fructose, ribose, or a combination thereof. The present invention thus provides fuel compositions derived from simple sugars, e.g., glucose, galactose, mannose, fructose, ribose, and combinations thereof, and methods of their production from the simple sugars Any suitable host cell may be used in the practice of the present invention. In one embodiment, the host cell is a genetically modified host microorganism in which nucleic acid molecules have been inserted, deleted or modified (i.e., mutated, e.g., by insertion, deletion, substitution, and/or inversion of nucleotides), to either produce the desired isoprenoid or isoprenoid derivative, or to increase yields of the desired isoprenoid or isoprenoid derivative. In another embodiment, the host cell is capable of being grown in liquid growth medium Illustrative examples of suitable host cells include archae cells, bacterial cells, and eukaryotic cells. Some nonlimiting examples of archae cells include those belong to the genera-*Aeropyrum, Archaeglobus, Halobacterium, Melhanococcus, Methanobacterium, Pyrococcus, Sulfolobus*, and *Thermoplasma*. Some nonlimiting examples of archae strains include *Aeropyrum pernix, Archaeoglobus fulgidus, Methanococcus jannaschn, Methanobacterium thermoautotrophicum, Pyrococcus abyssi, Pyrococcus honkoshii, Thermoplasma acidophilum*, and *Thermoplasma volcamum*, and the like.

Some nonlimiting examples of bacterial cells include those belonging to the genera *Agrobacterium, Alicyclobaallus, Anabaena, Anacystis, Arthrobacter, Azobacter, Bacillus, Brevibactenum, Chromatium, Clostridium, Corynebacterium, Enterobacter, Erwinia, Escherichia, Lactobacillus, Lactococcus, Mesorhizobium, Methylobacterium, Microbactenum, Phormidium, Pseudomonas, Rhodobacter, Rhodopseudomonas, Rhodospinllum, Rhodococcus, Salmonella, Scenedesmun, Serratia, Shigella, Staphylococcus, Streptomyces, Synnecoccus*, and *Zymomonas*.

Some nonlimiting examples of bacterial strains include *Bacillus subtilis, Bacillus amyloliquefaciens, Brevibactenum ammoniagenes, Brevibactenum immanophilum, Clostridium beijerinckii, Enterobacter sakazakii, Escherichia coli, Lactococcus lactis, Mesorhizobium loti, Pseudomonas aeruginosa, Pseudomonas mevalonu, Pseudomonas pudica, Rhodobacter capsulatus, Rhodobacter sphaeroides, Rhodospinllum rubrum, Salmonella entenca, Salmonella typhi, Salmonella typhimunum, Shigella dysenteriae, Shigella flexneri, Shigella sonnet, Staphylococcus aureus*, and the like In general, if a bacterial host cell is used, a nonpathogenic strain is preferred. Some nonlimiting examples of nonpathogenic strains include *Bacillus subtilis, Escherichia coli, Lactibacillus acidophilus, Lactobacillus helveticus, Pseudomonas aeruginosa, Pseudomonas mevalonu, Pseudomonas pudita, Rhodobacter sphaeroides, Rodobacter capsulatus, Rhodospinllum rubrum*, and the like.

Some nonlimiting examples of eukaryotic cells include fungal cells. Some nonlimiting examples of fungal cells include those belonging to the genera *Aspergillus, Candida, Chrysosponum, Cryotococcus, Fusanum, Kluyveromyces, Neotyphodium, Neurospora, Penicillium, Pichia, Saccharomyces*, and *Trichoderma*.

Some nonlimiting examples of eukaryotic strains include *Aspergillus nidulans, Aspergillus niger, Aspergillus oryzae, Candida albicans, Chrysosponum lucknowense, Fusanum grammearum, Fusanum venenatum, Kluyveromyces lactis, Neurospora crassa, Pichia angusta, Pichia finlandica, Pichia kodamae, Pichia membranaefaciens, Pichia methanolica, Pichia opuntiae, Pichia pastons, Pichia pijpen, Pichia quercuum, Pichia salictaria, Pichia thermotolerans, Pichia trehalophila, Pichia stipitis, Streptomyces ambofaciens, Streptomyces aureofaciens, Streptomyces aureus, Saccaromyces bayanus, Saccaromyces boulardi, Saccharomyces cerevisiae,*

*Streptomyces fungicidicus, Streptomyces griseochromogenes, Streptomyces griseus, Streptomyces lividans, Streptomyces olivogriseus, Streptomyces rameus, Streptomyces tanashiensis, Streptomyces vinaceus*, and *Trichoderma reesei*.

In general, if a eukaryotic cell is used, a nonpathogenic strain is preferred. Some nonlimiting examples of nonpathogenic strains include *Fusarium graminearum, Fusarium venenatum, Pichia pastoris, Saccaromyces boulardi*, and *Saccaromyces cerevisiae*.

In addition, certain strains have been designated by the Food and Drug Administration as GRAS or Generally Regarded As Safe. Some nonlimiting examples of these strains include *Bacillus subtilis, Lactibacillus acidophilus, Lactobacillus helveticus*, and *Saccharomyces cerevisiae*.

2. Biosynthetic Pathways to Synthesize IPP

There are two known biosynthetic pathways that synthesize IPP and its isomer, dimethylallyl pyrophosphate ("DMAPP"). Eukaryotes other than plants use the mevalonate-dependent ("MEV") isoprenoid pathway exclusively to convert acetyl-coenzyme A ("acetyl-CoA") to IPP, which is subsequently isomerized to DMAPP. Prokaryotes, with some exceptions, use the mevalonate-independent or deoxyxylulose 5-phosphate ("DXP") pathway to produce IPP and DMAPP separately through a branch point. In general, plants use both the MEV and DXP pathways for IPP synthesis.

a) MEV Pathway

The MEV pathway is well-understood and comprises six steps as follows:

In the first step, two molecules of acetyl-coenzyme A are enzymatically combined to form acetoacetyl-CoA. An enzyme known to catalyze this step is, for example, acetyl-CoA thiolase. Some non limiting examples of nucleotide sequences encoding such an enzyme include the following GenBank accession numbers and the organism from which the sequences are derived: (NC 000913 REGION: 2324131.2325315; *Escherichia coli*), (D49362; *Paracoccus denitrificans*), and (L20428; *Saccharomyces cerevisiae*).

In the second step of the MEV pathway, acetoacetyl-CoA is enzymatically condensed with another molecule of acetyl-CoA to form 3-hydroxy-3-methylglutaryl-CoA (HMG-CoA). An enzyme known to catalyze this step is, for example, HMG-CoA synthase. Some nonlimiting examples of nucleotide sequences encoding such an enzyme include (NC_001 145. complement 19061.20536; *Saccharomyces cerevisiae*), (X96617; *Saccharomyces cerevisiae*), (X83882; *Arabidopsis thaliana*), (AB037907; *Kitasatospora griseola*), (BT007302; *Homo sapiens*), and (NC_002758, Locus tag SAV2546, GeneID 1 122571; *Staphylococcus aureus*).

In the third step, HMG-CoA is enzymatically converted to mevalonate. An enzyme known to catalyze this step is, for example, HMG-CoA reductase. Some nonlimiting examples of nucleotide sequences encoding such an enzyme include (NM_206548; *Drosophila melanogaster*), (NC_002758, Locus tag SAV2545, GeneID 1 122570; *Staphylococcus aureus*), (NM_204485; *Gallus gallus*), (ABO1 5627; *Streptomyces* sp. KO 3988), (AF542543; *Nicotiana attenuata*), (AB037907; *Kitasatospora griseola*), (AX 128213, providing the sequence encoding a truncated HMGR; *Saccharomyces cerevisiae*), and (NCJ)O 1 145: complement (1 15734.1 18898; *Saccharomyces cerevisiae*).

In the fourth step, mevalonate is enzymatically phosphorylated to form mevalonate 5-phosphate. An enzyme known to catalyze this step is, for example, mevalonate kinase. Some nonlimiting examples of nucleotide sequences encoding such an enzyme include (L77688; *Arabidopsis thaliana*) and (X55875; *Saccharomyces cerevisiae*).

In the fifth step, a second phosphate group is enzymatically added to mevalonate 5-phosphate to form mevalonate 5-pyrophosphate. An enzyme known to catalyze this step is, for example, phosphomevalonate kinase. Some nonlimiting examples of nucleotide sequences encoding such an enzyme include (AF429385; *Hevea brasiliensis*), (NM_006556; *Homo sapiens*), and (NC_001 145. complement 712315.713670; *Saccharomyces cerevisiae*).

In the sixth step, mevalonate 5-pyrophosphate is enzymatically converted into IPP. An enzyme known to catalyze this step is, for example, mevalonate pyrophosphate decarboxylase. Some nonlimiting examples of nucleotide sequences encoding such an enzyme include (X97557; *Saccharomyces cerevisiae*), (AF290095; *Enterococcus faecium*), and (U49260; *Homo sapiens*).

If IPP is to be converted to DMAPP, then a seventh step is required. An enzyme known to catalyze this step is, for example, IPP isomerase. Some nonlimiting examples of nucleotide sequences encoding such an enzyme include (NCJ)00913, 3031087.3031635; *Escherichia coli*) and (AF082326; *Haematococcus pluvialis*).

b) DXP Pathway

The DXP pathway is also well characterized and well understood by those of skill in the art. In general, the DXP pathway comprises seven steps. In the first step, pyruvate is condensed with D-glyceraldehyde 3-phosphate to make 1-deoxy-D-xylulose-5-phosphate. An enzyme known to catalyze this step is, for example, 1-deoxy-D-xylulose-5-phosphate synthase. Some nonlimiting examples of nucleotide sequences that encode such an enzyme include (AF035440; *Escherichia coli*), (NCJ)02947, locus tag PP0527; *Pseudomonas putida* KT2440), (CP000026, locus tag SP A2301; *Salmonella enterica Paratyphi*, see, ATCC 9150), (NCJJ07493, locus tag RSP_0254; *Rhodobacter sphaeroides* 2.4.1), (NCJ)05296, locus tag RPA0952; *Rhodopseudomonas palustris CGA*009), (NCJ)04556, locus tag PD1293; *Xylella fastidiosa Temeculal*), and (NC_003076, locus tag AT5G 1 1380; *Arabidopsis thaliana*).

In the second step, 1-deoxy-D-xylulose-5-phosphate is converted to 2C-methyl-D-erythritol-4-phosphate. An enzyme known to catalyze this step is, for example, 1-deoxy-D-xylulose-5-phosphate reductoisomerase. Some nonlimiting examples of nucleotide sequences that encode such an enzyme include (ABO 13300; *Escherichia coli*), (AF 148852; *Arabidopsis thaliana*), (NC_002947, locus tag PP1 597; *Pseudomonas putida* KT2440), (AL939124, locus tag SCO5694; *Streptomyces coelicolor* A3(2)), (NC_007493, locus tag RSP_2709; *Rhodobacter sphaeroides* 2.4.1), and (NCJ)07492, locus tag Pf1_1107; *Pseudomonas fluorescens* PfO-1).

In the third step, 2C-methyl-D-erythritol-4-phosphate is converted to 4-diphosphocytidyl-2C-methyl-D-erythritol. An enzyme known to catalyze this step is, for example, 4-diphosphocytidyl-2C-methyl-D-erythritol synthase. Some nonlimiting examples of nucleotide sequences that encode such an enzyme include (AF230736; *Escherichia coli*), (NC_007493, locus tag RSP_2835; *Rhodobacter sphaeroides* 2.4.1), (NC_003071, locusjag AT2G02500; *Arabidopsis thaliana*), and (NC_002947, locusjag PP1614; *Pseudomonas putida* KT2440).

In the fourth step, 4-diphosphocytidyl-2C-methyl-D-erythritol is converted to 4-diphosphocytidyl-2C-methyl-D-erythritol-2-phosphate. An enzyme known to catalyze this step is, for example, 4-diphosphocytidyl-2C-methyl-D-erythritol kinase. Some nonlimiting examples of nucleotide sequences that encode such an enzyme include (AF216300;

*Escherichia coli*) and (NC_007493, locusjag RSPJ 779; *Rhodobacter sphaeroides* 2.4.1).

In the fifth step, 4-diphosphocytidyl-2C-methyl-D-erythritol-2-phosphate is converted to 2C-methyl-D-erythritol 2,4-cyclodiphosphate. An enzyme known to catalyze this step is, for example, 2C-methyl-D-erythritol 2,4-cyclodiphosphate synthase. Some nonlimiting examples of nucleotide sequences that encode such an enzyme include (AF230738; *Escherichia coli*), (NC_007493, locusjag RSPJ5071; *Rhodobacter sphaeroides* 2.4.1), and (NC 002947, locusjag PP1618; *Pseudomonas putida* K.T2440).

In the sixth step, 2C-methyl-D-erythritol 2,4-cyclodiphosphate is converted to 1-hydroxy-2-methyl-2-(E)-butenyl-4-diphosphate. An enzyme known to catalyze this step is, for example, 1-hydroxy-2-methyl-2-(E)-butenyl-4-diphosphate synthase. Some nonlimiting examples of nucleotide sequences that encode such an enzyme include (AY033515; *Escherichia coli*), (NCJ)02947, locusjag PP0853; *Pseudomonas putida* KT2440), and (NC_007493, locusjag RSP_2982; *Rhodobacter sphaeroides* 2.4.1).

In the seventh step, 1-hydroxy-2-methyl-2-(E)-butenyl-4-diphosphate is converted to either IPP or its isomer, DMAPP. An enzyme known to catalyze this step is, for example, isopentyl/dimethylallyl diphosphate synthase. Some nonlimiting examples of nucleotide sequences that encode such an enzyme include (AY062212; *Escherichia coli*) and (NC_002947, locusjag PP0606; *Pseudomonas putida* KT2440).

In some embodiments, "cross talk" (or interference) between the host cell's own metabolic processes and those processes involved with the production of IPP as provided by the present invention are minimized or eliminated entirely. For example, cross talk is minimized or eliminated entirely when the host microorganism relies exclusively on the DXP pathway for synthesizing IPP, and a MEV pathway is introduced to provide additional IPP. Such a host organisms would not be equipped to alter the expression of the MEV pathway enzymes or process the intermediates associated with the MEV pathway. Organisms that rely exclusively or predominately on the DXP pathway include, for example, *Escherichia coli.*

In some embodiments, the host cell produces IPP via the MEV pathway, either exclusively or in combination with the DXP pathway. In other embodiments, a host's DXP pathway is functionally disabled so that the host cell produces IPP exclusively through a heterologously introduced MEV pathway. The DXP pathway can be functionally disabled by disabling gene expression or inactivating the function of one or more of the DXP pathway enzymes.

3. Biosynthetic Preparation of FPP and Monocyclic Sesquiterpene Starting Materials from FPP The $C_{15}$ isoprenoid starting materials useful in generating the fuel compositions of the present invention are sesquiterpenes and, in particular, monocyclic sesquiterpenes having a monocyclic (cyclohexene) moiety and a branched alkene moiety. Examples of useful sesquiterpenes include, but are not limited to, α-zingiberene, β-sesquiphellandrene, α-bisabolene, β-bisabolene, γ-bisabolene, curcumene, gossonorol and mixtures thereof (see, FIG. 1). In a preferred embodiment, the monocyclic sesquiterpene is α-bisabolene. In another preferred embodiment, the monocyclic sesquiterpene is α-zingiberene. In yet another preferred embodiment, the monocyclic sesquiterpene is a mixture of α-bisabolene and α-zingiberene.

Typically, the $C_{15}$ monocyclic sesquiterpene starting materials are prepared by the conversion of farnesyl pyrophosphate ("FPP") using sesquiterpene synthases. Like IPP, FPP can be made biologically. In general, two molecules of IPP and one molecule of DMAPP are condensed to form FPP. In some embodiments, the reaction can be catalyzed by an enzyme known to catalyze this step, for example, farnesyl pyrophosphate synthase.

Some nonlimiting examples of nucleotide sequences that encode a farnesyl pyrophosphate synthase include (ATU80605; *Arabidopsis thaliana*), (ATHFPS2R; *Arabidopsis thaliana*), (AAU36376; *Artemisia annua*), (AF461050; *Bos taurus*), (D00694; *Escherichia coli* K-12), (AE009951, Locus AAL95523; *Fusobacterium nucleatum* subsp. *nucleatum* ATCC 25586), (GFFPPSGEN; *Gibberella fujikuroi*), (CP000009, Locus AAW60034; *Gluconobacter oxydans* 621H), (AFO 19892; *Helianthus annum*), (HUMFAPS; *Homo sapiens*), (KLPFPSQCR; *Kluyveromyces lactis*), (LAU 15777; *Lupinus albus*), (L AU20771; *Lupinus albus*), (AF309508; *Mus musculus*), (NCFPPSGEN; *Neurospora crassa*), (PAFPS1; *Parthenium argentatum*), (PAFPS2; *Parthenium argentatum*), (RATFAPS; *Rattus norvegicus*), (YSCFPP; *Saccharomyces cerevisiae*), (D89104; *Schizosaccharomyces pombe*), (CP000003, Locus AAT87386; *Streptococcus pyogenes*), (CPOOOOl7, Locus AAZ51849; *Streptococcus pyogenes*), (NC_008022, Locus YP_598856; *Streptococcus pyogenes* MGAS 10270), (NC_008023, Locus YP_600845; *Streptococcus pyogenes* MGAS2096), (NC_008024, Locus YP_602832; *Streptococcus pyogenes* MGAS 10750), and (MZEFPS; *Zea mays*).

Methods for the biological production of both IPP and FPP have been previously described by references including PCT International Publication No. WO 2006/014837 and U.S. Publication Nos. 2003/0148479, 2004/0005678, and 2006/0079476.

Figure 2:
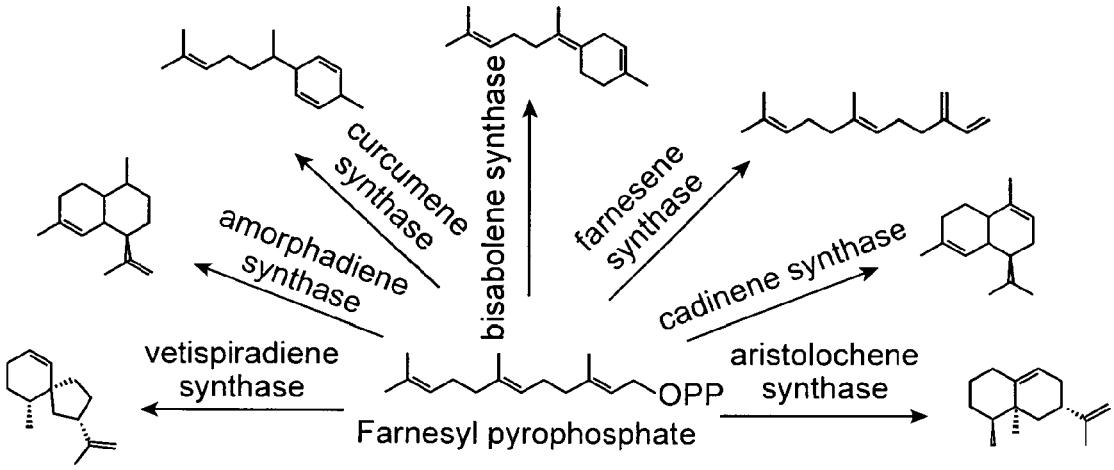
FIG. 2 (*a*) illustrates various sesquiterpene synthases that can be used to generate the isoprenoids from farnesyl pyrophosphate.
Figure 2:
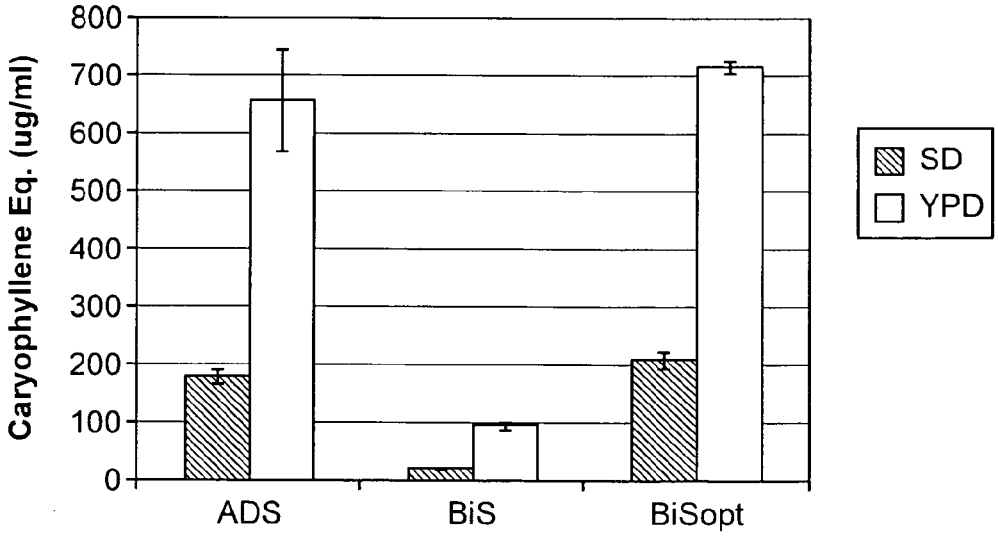
Figure 3A:
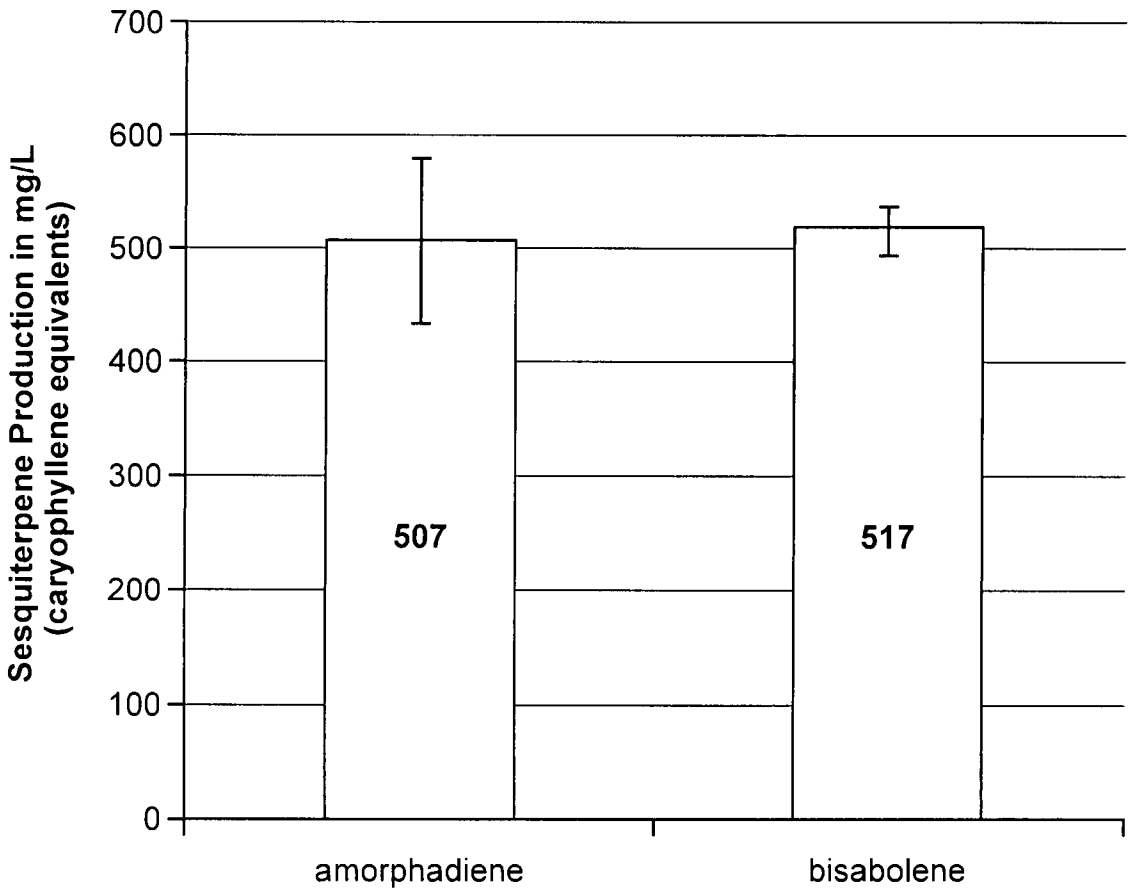
FIG. 3(*a*) illustrates the production of bisabolene in *E. coli* using the bisabolene codon optimized bisabolene gene from grand fir (*Abies grandis*).
Figure 3B:
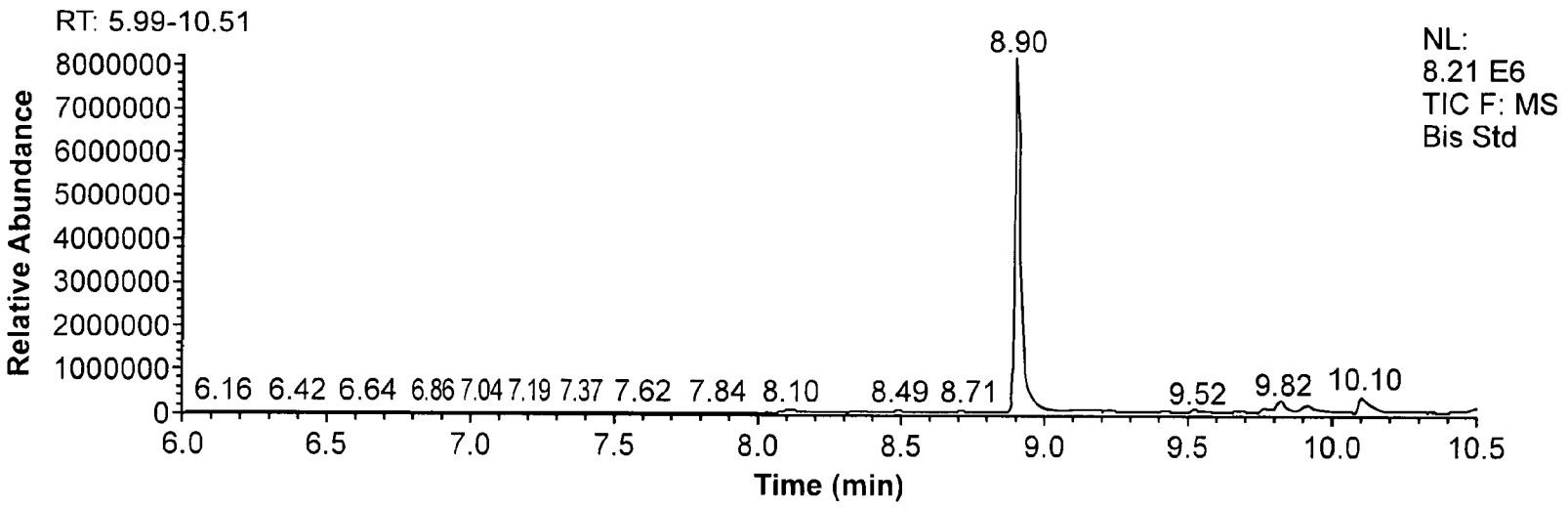
Figure 3B:
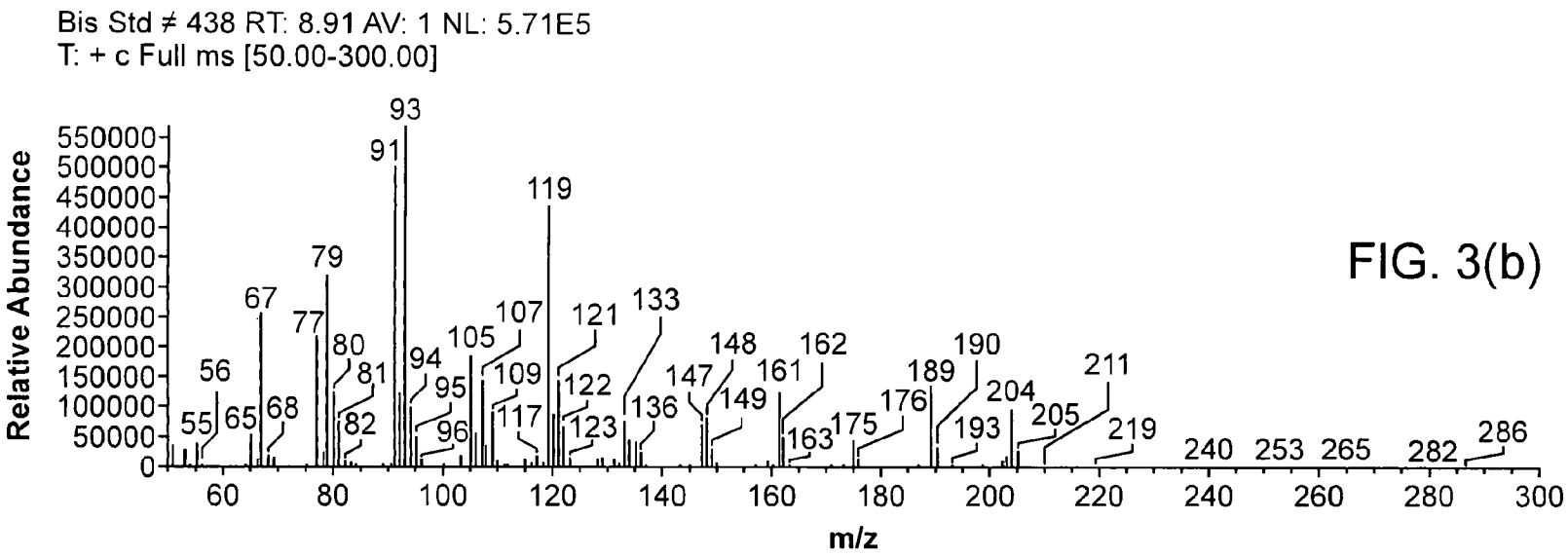
Figure 3C:
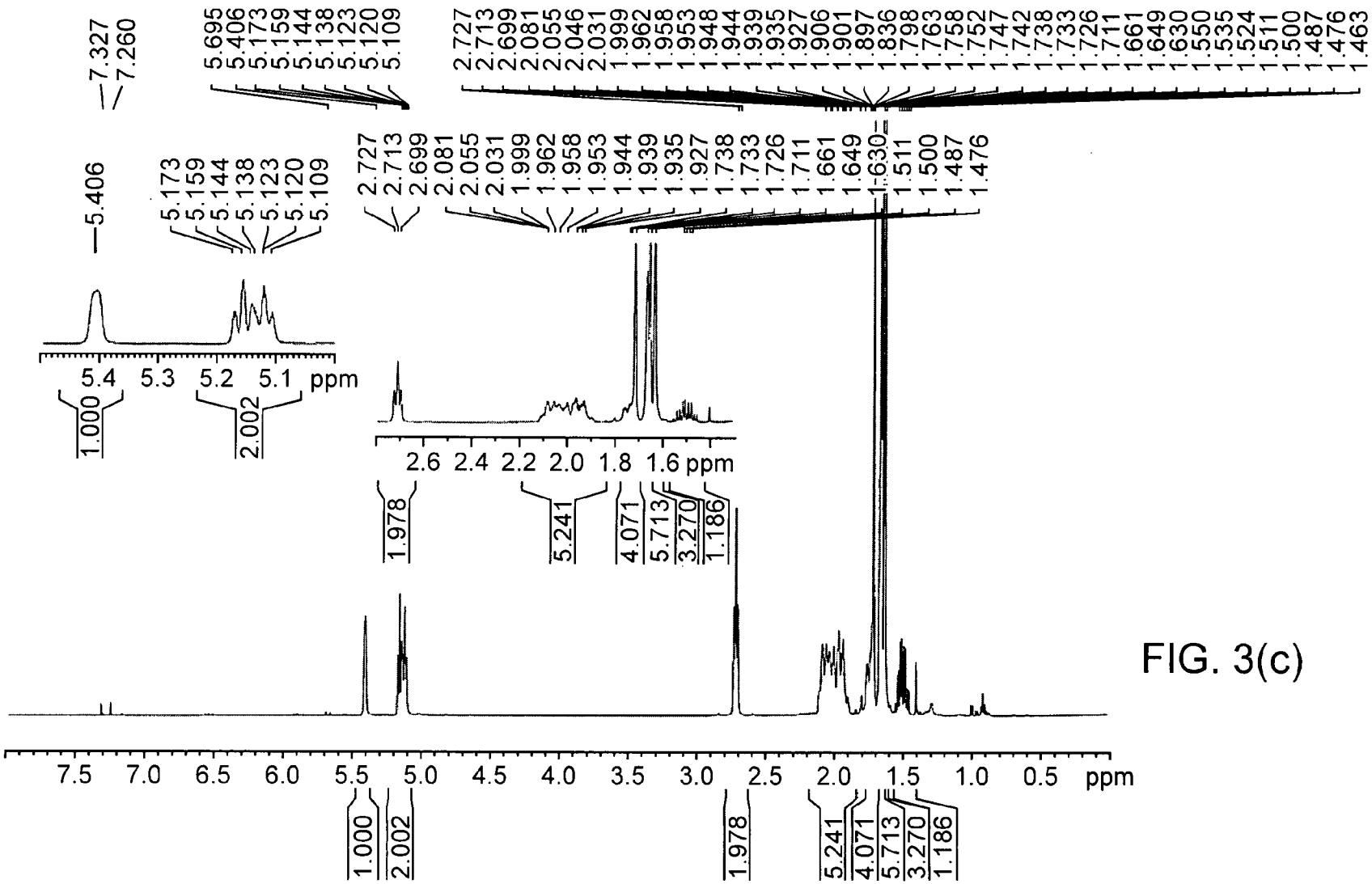
Figure 3D:
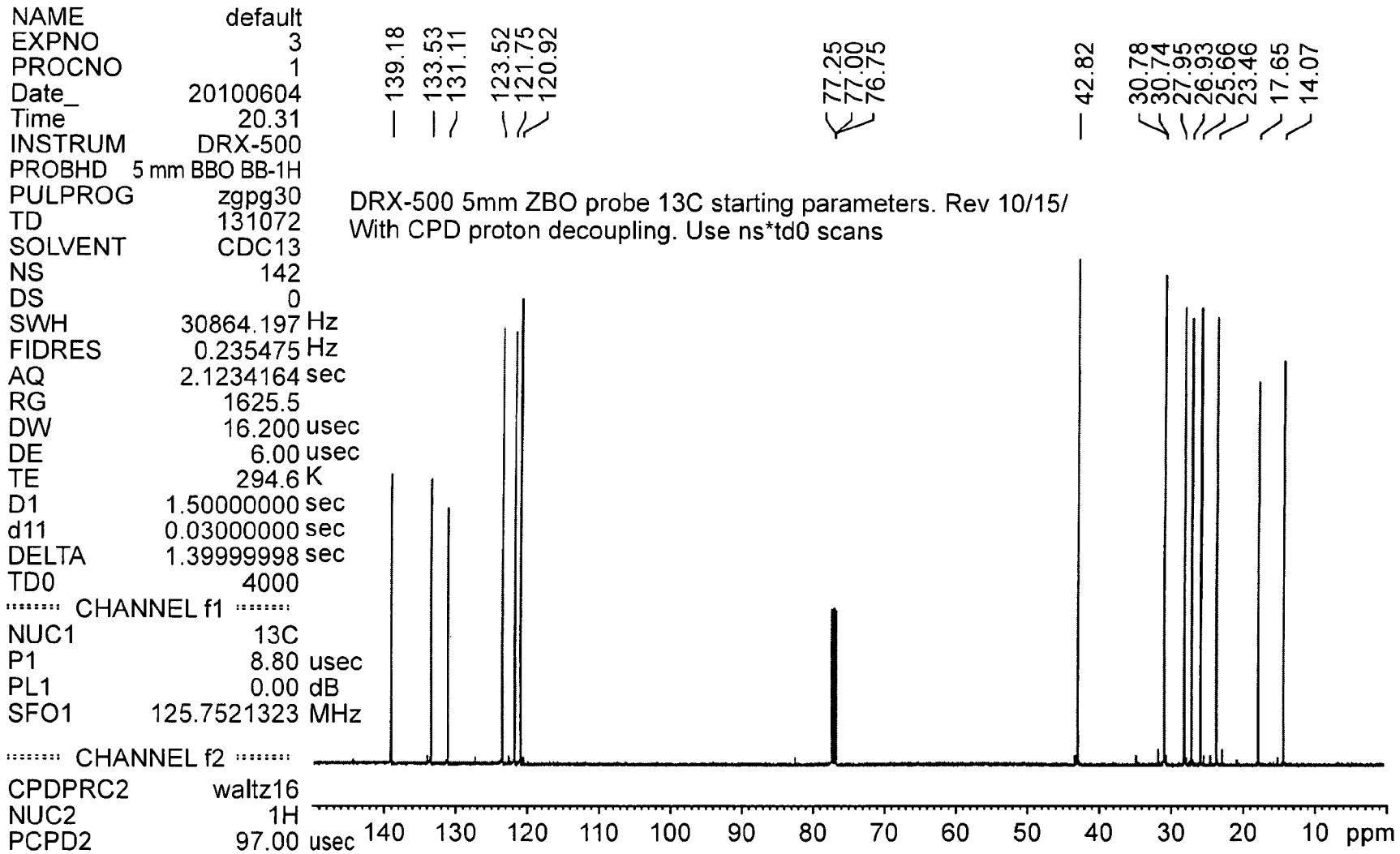

Once prepared, the FPP is converted to the $C_{15}$ monocyclic sesquiterpene starting material of interest using a sesquiterpene synthases (see, e.g., FIG. 2). Examples of suitable sesquiterpene synthases are disclosed in Degenhardt, et al., Phytochemistry, 70:1621-1637 (2009), and PCT International Publication No. WO/2006/134523, the teachings of both of which are incorporated herein by reference for all purposes. Nonlimiting examples of the monocyclic sesquiterpene compounds useful as the starting materials in the preparation of the hydrogenations products of the present invention are as follows:

(E)-α-Bisabolene (E)-α-Bisabolene, whose structure is as follows:

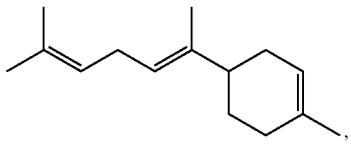

is found in various biological sources including, but not limited to, grand fir, spruce, etc. Biochemically, α-bisabolene is made from FPP by α-bisabolene synthase. Some nonlimiting examples of suitable nucleotide sequences that encode such an enzyme include (AAC24192; *Abies grandis*), (AAS47689; *Picea abies*), etc. (see, e.g., Degenhardt, et al., *Phytochemistry,* 70:1621-1637 (2009); Bohlmann, et al., *Proc. Natl. Acad. Sci. USA* 95:4126-4133 (1998); and Martin et al., *Plant Physiol.* 135:1908-1927 (2004)). Using the α-bisabolene synthase from grand fur (i.e., *Abies grandis*), which has been codon optimized, (E)-α-bisabolene can be prepared in very high titer, i.e., 100% reaction yield without any side-product formation, and at a rate similar to that found for amorphadiene, which is an intermediate of antimalarial artemisinin biosynthesis that has become the reference molecule for the sesquiterpene production, wherein the most recent industry studies are demonstrating over 27 g/L of amorphadiene titer in fed-batch fermentation (see, FIG. 3(*a*)). Moreover, from FIG. 3(*b*), it is seen that the microbially produced product is confirmed to be bisabolene.

(S)-β-Bisabolene (S)-β-Bisabolene, whose structure is as follows:

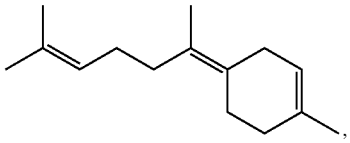

is found in various biological sources including, but not limited to, corn, etc. Biochemically, β-bisabolene is made from FPP by β-bisabolene synthase. Some nonlimiting examples of suitable nucleotide sequences that encode such an enzyme include (AAS88571; *Zea mays*), etc. (see, e.g., Degenhardt, et al., *Phytochemistry,* 70:1621-1637 (2009); and Kollner, et al., *Plant Cell* 16:1115-1131 (2004)).

(E)-γ-Bisabolene (E)-γ-Bisabolene, whose structure is as follows:

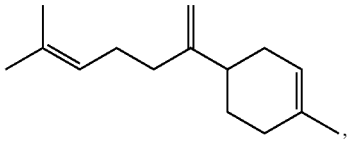

is found in various biological sources including, but not limited to, Douglas-fir, etc. Biochemically, (E)-γ-bisabolene is made from FPP by a γ-bisabolene synthase. Some nonlimiting examples of suitable nucleotide sequences that encode such an enzyme include (AAX07266; *Pseudotsuga menziesii*), etc. (see, e.g., Degenhardt, et al., *Phytochemistry,* 70:1621-1637 (2009); and Huber, et al., *Phytochemistry,* 66:1427-1439 (2005)). Similarly, (Z)-γ-bisabolene, which is found, for example, is Mouse-ear cress, is biochemically made from FPP by a (Z)-γ-bisabolene synthase. Some nonlimiting examples of suitable nucleotide sequences that encode such an enzyme include (NP_193064 and NP_193066; *Arabidopsis thaliana*) (see, e.g., Degenhardt, et al., Phytochemistry, 70:1621-1637 (2009); and Ro, et al., *Arch. Biochem. Biophys.,* 448:104-116 (2006)).

α-Zingiberene

α-Zingiberene, whose structure is as follows:

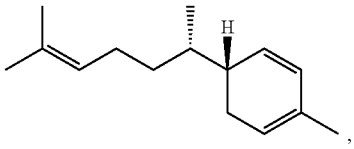

is found in various biological sources including, but not limited to, the oil of ginger (*Zingiber officinale*), from which it gets its name, leaf extracts of wild tomato and lemon basil. Biochemically, α-zingiberene is made from FPP by α-zingiberene synthase. Some nonlimiting examples of suitable nucleotide sequences that encode such an enzyme include (AY693646; *Ocimum basilicum*), (AAV63788; *Ocimum basilicum*), (EU596452; *Ocimum basilicum*), etc. (see, e.g., Degenhardt, et al., *Phytochemistry,* 70:1621-1637 (2009); Iijima, et al., *Plant Physiol.* 136:3724-3736-4133 (2004); and Davidovich-Rikanati, et al., *The Plant Journal,* "Overexpression of the lemon basil α-zingiberene synthase gene increases both mono- and sesquiterpene contents in tomato fruit," 56(2):228-238 (2008)).

It will be readily apparent to those of skill in the art that the other monocyclic sesquiterpenes set forth in FIG. 1(*b*), including curcumene, gossonorol and β-sesquiphellandrene, can be prepared from FPP in a similar manner using the appropriate sesquiterpene synthase.

B. Chemical Conversion of the Monocyclic Sesquiterpenes to the Fuel Component

The fuel component of the fuel composition of the present invention will comprise, alone or in part, bisabolane (or 1(1,5-dimethylhexyl)-4-methylcyclohexane), which has the following structure:

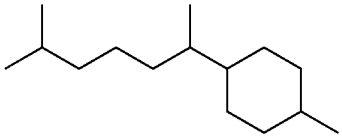

Bisabolane can be prepared by any method known in the art including biological methods, as described herein, or chemical synthesis methods (without the use of biologically derived materials). In one embodiment, the monocyclic sesquiterpene starting material, such as (E)-α-Bisabolene, (E)-α-Zingiberene, or mixtures thereof, is isolated from naturally occurring sources. In other embodiments, the monocyclic sesquiterpene starting material, such as (E)-α-Bisabolene, (E)-α-Zingiberene, or mixtures thereof, is made by a host cell that has been modified either to produce the monocyclic sesquiterpene compound or to increase the yields of the naturally occurring compound.

Irrespective of its source, each of the monocyclic sesquiterpene, i.e., $C_{15}$-isoprenoid, starting materials can be chemically converted into a fuel component disclosed herein by any known reduction reaction such as hydrogenation. In some embodiments, the monocyclic sesquiterpene starting material can be reduced by hydrogen with a catalyst such as Pd, Pd/C, Pt, $PtO_2$, $Ru(PPh_3)_2Cl_2$, Raney nickel, or combinations thereof. In one embodiment, the catalyst is a Pd catalyst. In another embodiment, the catalyst is 5% Pd/C. In a further embodiment, the catalyst is 10% Pd/C in a high pressure reaction vessel and the reaction is allowed to proceed until completion. Generally, after completion, the reaction mixture can be washed, concentrated, and dried to yield the corresponding hydrogenated product. Alternatively, any reducing agent that can reduce a C═C bond to a C—C bond can also be used. For example, the monocyclic sesquiterpene starting material can be hydrogenated by treatment with hydrazine in the presence of a catalyst, such as 5-ethyl-3-methyllumiflavinium perchlorate, under $O_2$ atmosphere to give the corresponding hydrogenated products. The reduction reaction with hydrazine is disclosed in Imada et al., *J. Am. Chem. Soc.* 127:14544-14545 (2005), which is incorporated herein by reference.

In some embodiments, the C═C bonds in the monocyclic sesquiterpene starting material are reduced to the corresponding C—C bonds by hydrogenation in the presence of a catalyst and hydrogen at room temperature. In a further embodiment, the catalyst is a 10% Pd/C.

As will be appreciated by those of skill in the art that depending on the monocyclic sesquiterpene starting material employed and the hydrogenation reaction employed, the resulting bisabolane may be a diastereomeric mixture of bisabolane or a pure mixture of bisabolene, the resulting bisabolane may be in a mixture with other reaction products of the hydrogenation reaction. Although complete hydrogenation to achieve bisabolane in 100% yield is ideal, it has been found that the other resulting mixtures, which include, in part, bisabolane, are also useful as alternative diesel or jet fuels.

V. EXAMPLES

The present invention will be described in greater detail by way of specific examples. The following examples are offered for illustrative purposes, and are not intended to limit the invention in any manner. Those of skill in the art will readily recognize a variety of noncritical parameters which can be changed or modified to yield essentially the same results.

Example 1

Biosynthesis of Bisabolene and Zingiberene

The host cells harboring mevalonate pathway genes and terpene synthase genes (such as bisabolene synthase and/or zingiberene synthase) were prepared and grown in production media with optimal temperature and shaking condition. The mevalonate pathway genes are derived from several different species including bacteria and yeast. Terpene synthase genes were synthesized from commercial gene synthesis companies based on the known protein sequence of corresponding terpene synthases. In this example, bisabolene synthase from *Abies grandis*, and zingiberene synthase from lemon basil were used, but those of skill in the art will appreciate that the origin of these proteins is not limited to these species.

For the test of the sesquiterpene production, culture medium was overlaid with immiscible organic solvent, and the sesquiterpenes products were accumulated in the organic layer for the product analysis. GC/MS analysis has been performed to check the biosynthetic product identification, and the production of pure bisabolene and zingiberene was confirmed (see, FIGS. 2(*c*), 3(*a*) and 3(*b*)).

Metabolic Engineering for Bisabolene Production in *E. coli*

Using an *E. coli* codon optimized version of *Abies grandis* (AgBIS), FPP was produced via metabolic engineering of the mevalonate pathway. For optimization, the mevalonate pathway was conceptually divided into a top portion that converts acetyl-CoA into mevalonate and a bottom portion that converts mevalonate into FPP. The mevalonate pathway is heterologous to *E. coli*, and the genes encoding truncated HMG-CoA reductase (tHMGR), HMG-CoA synthase (HMGS), mevalonate kinase (MK), phosphomevalonate kinase (PMK), and mevalonate diphosphate decarboxylase (PMD) were derived from *S. cerevisiae* (Martin et al., *Nat. Biotechnol.* 21, 796-802 (2003)). The *E. coli* strain harboring AgBIS with a heterologous mevalonate pathway (pJBEI-2704) produced 388±49 mg/L bisabolene. Four of the five *S. cerevisiae* genes present in the mevalonate pathway (tHMGR, HMGS, MK, and PMK) were optimized to match the *E. coli* codon usage to generate pJBEI-2997. PMD was not codon-optimized, as previous proteomic studies showed high protein levels of PMD (Redding-Johanson et al., *J. Metab. Eng.* 13, 194-203 (2011)). This platform produced 586±65 mg/L bisabolene. To improve expression of the enzymes in the bottom portion of the pathway, these genes were placed under control of a second promoter ($P_{trc}$) (pJBEI-2999). This platform produced 912±43 mg/L of bisabolene.

Bisabolene Production in *S. cerevisiae*

A previously engineered *S. cerevisiae* FPP overproduction platform was adapted for the production of bisabolene. In the *S. cerevisiae* FPP overproduction platform, the truncated HMG-CoA reductase (tHMGR), the FPP synthase (Erg20), and the global transcription regulator of the sterol pathway upc2-1 were overexpressed and the squalene synthase (Erg9) was down-regulated from the chromosome (Ro et al., Nature 440, 940-943 (2006)). This yeast platform was adapted for the production of bisabolene by placing the bisabolane synthases under control of the galactose promoter on a high copy plasmid (4) containing the auxotrophic Leu2d marker previously used to achieve the highest production of amorphadiene (Ro et al., *BMC Biotechnol.* 8, 83 (2008)). Given that in vivo enzymatic activity is sometimes context (organism) dependent (Ro et al, *Nature* 440, 940-943 (2006), Chang et al., *Nat Chem Biol.* 3, 274-277 (2007)), we screened the same bisabolene synthases previously screened in *E. coli* in *S. cerevisiae*. All three-domain sesquiterpene synthases produced bisabolene in *S. cerevisiae*. *P. abies* TPS-BIS produced 23±7 mg/L bisabolene, *P. meziessi* TPS3 produced 69±7 mg/L bisabolene, and *A. grandis* Ag1 produced 66±11 mg/L. The highest production was achieved using AgBIS at 994±241 mg/L.

Bisabolene Microbial Toxicity

Commercial bisabolene imparted low to no toxicity to *E. coli* and *S. cerevisiae* when added exogenously to the medium. The *E. coli* and *S. cerevisiae* cell growth were comparable at 0% (v/v) bisabolene and up to 20% (v/v) of exogenously added bisabolene. Above 20% (v/v) of exogenously added bisabolene, bisabolene phase-separated from the culture medium.

Example 2

Production of Hydrogenated Bisabolene

A palladium on carbon catalyst was used to chemically reduce biosynthetic bisabolene into fully hydrogenated bisabolanes. Biosynthetic bisabolene isolated from *E. coli* cell cultures was fully reduced into to a 3:1 mixture of bisabolanes (data not shown). Bisabolene was fully hydrogenated to bisabolane as demonstrated by the lack of vinylic protons in the $^{1}H$ NMR spectrum and the lack of alkenes and $^{13}C$ NMR spectrum (FIGS. 4(*b*) and 4(*c*), respectively).

Figure 4A:
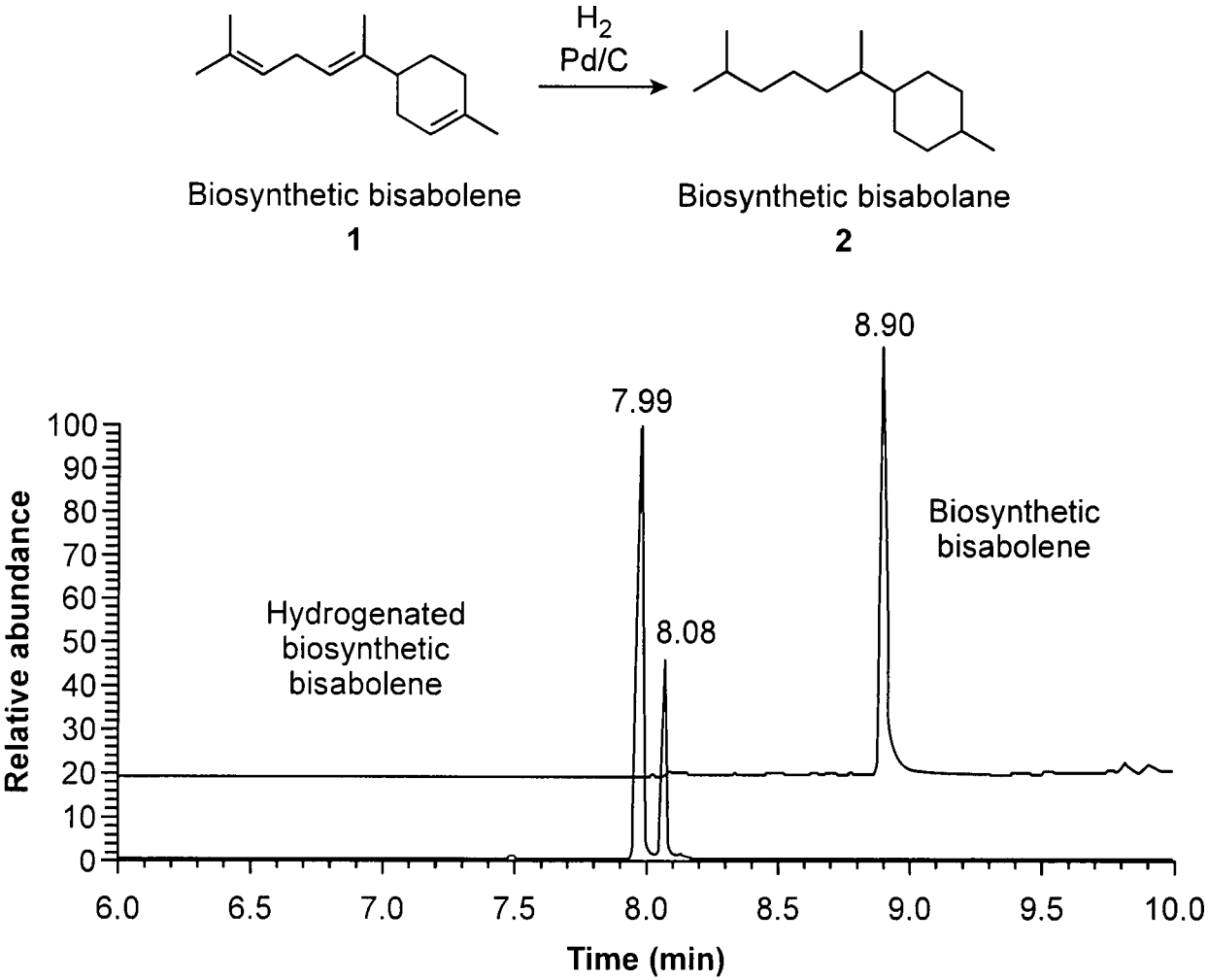
FIG. 4(*a*) illustrates the chemical hydrogenation of the fuel target biosynthetic bisabolene (1) to produce the bisabolene hydrogenation product (2). Gas chromatogram trace of biosynthetic bisabolene (RT: 8.90) and fully hydrogenated biosynthetic bisabolene. Hydrogenation of biosynthetic bisabolene leads to a mixture of two geometric bisabolane isomers (RT: 7.99 and 8.08) in a 3:1 ratio.
Figure 4B:
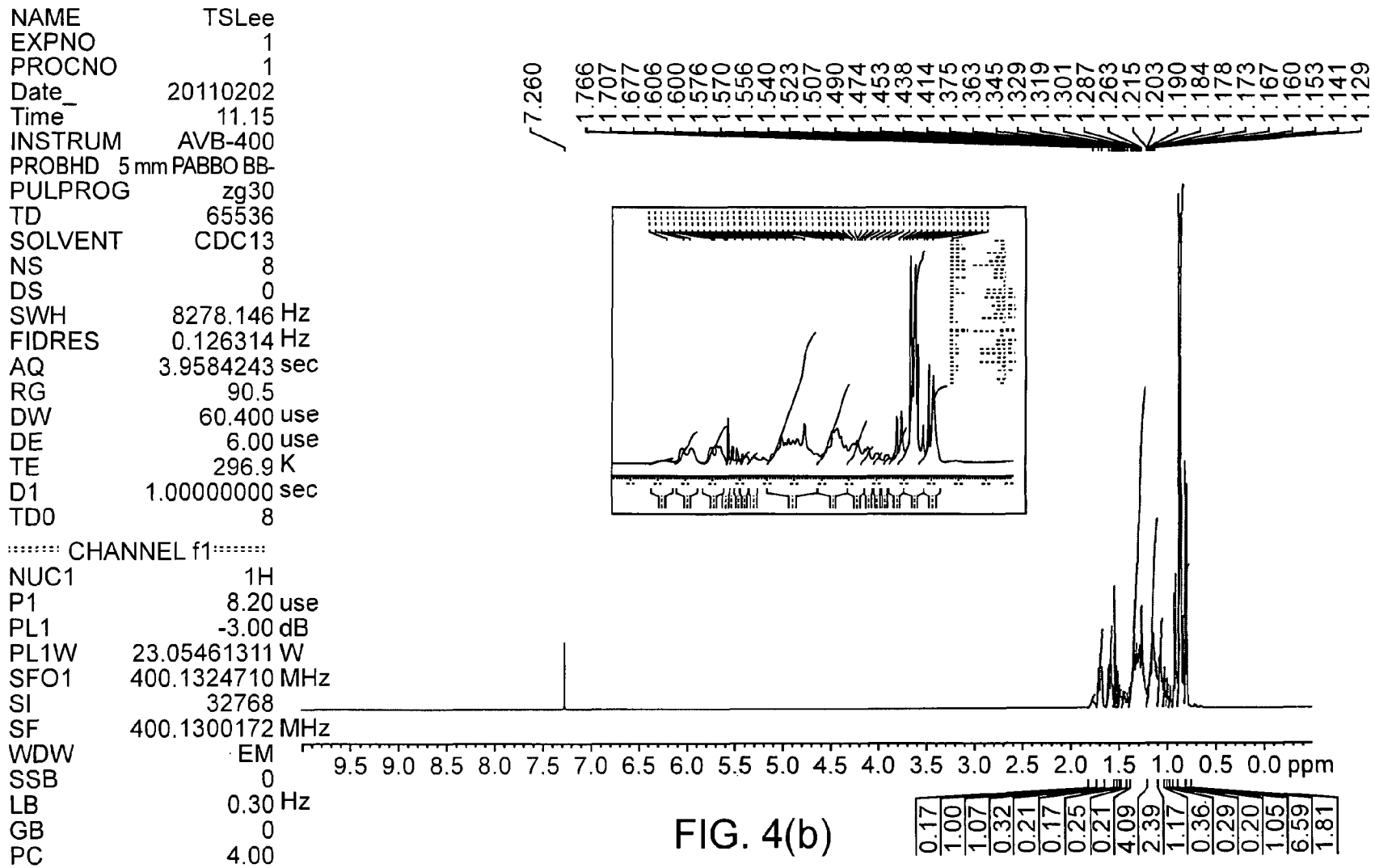
Figure 4C:
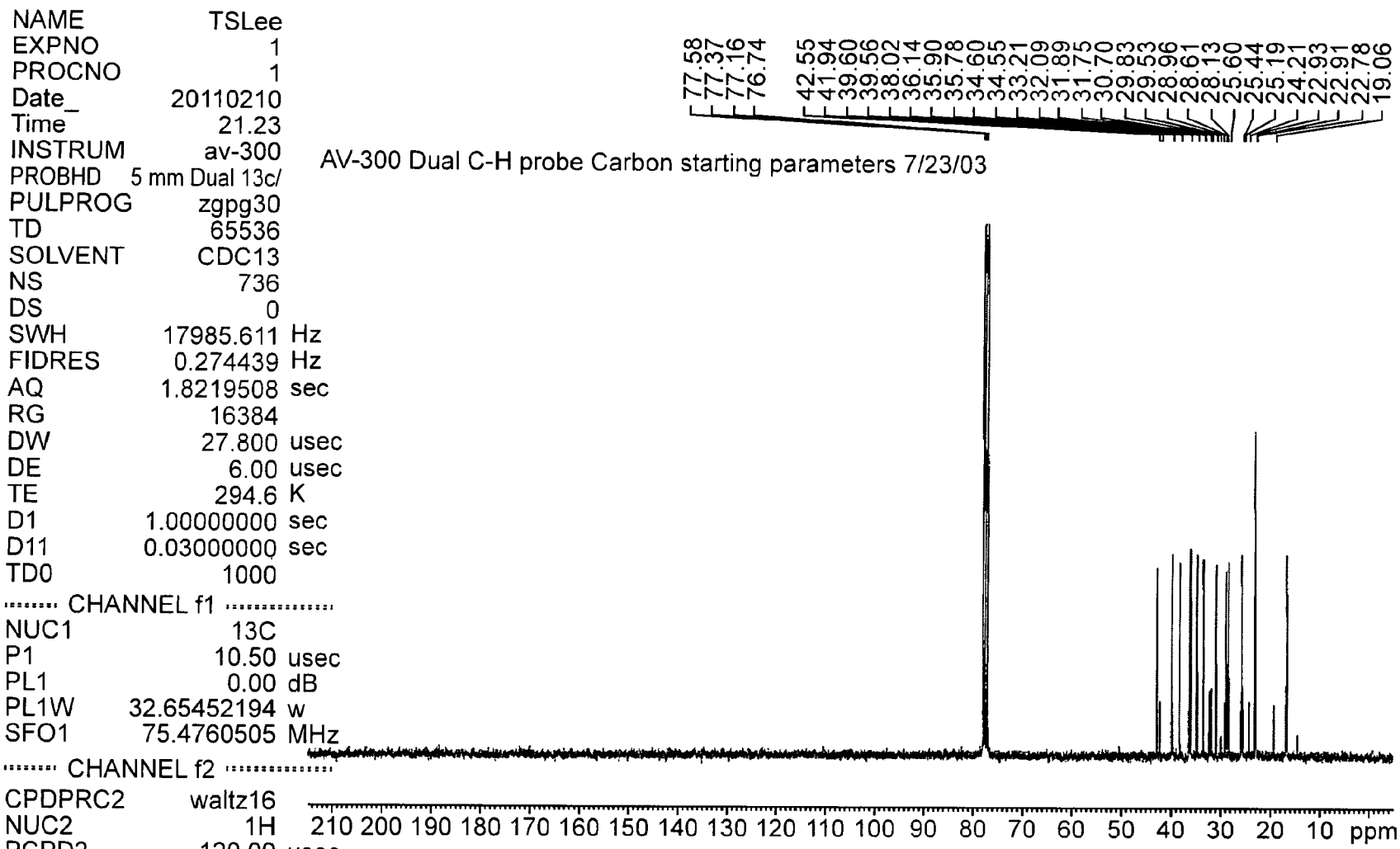
Figure 5:
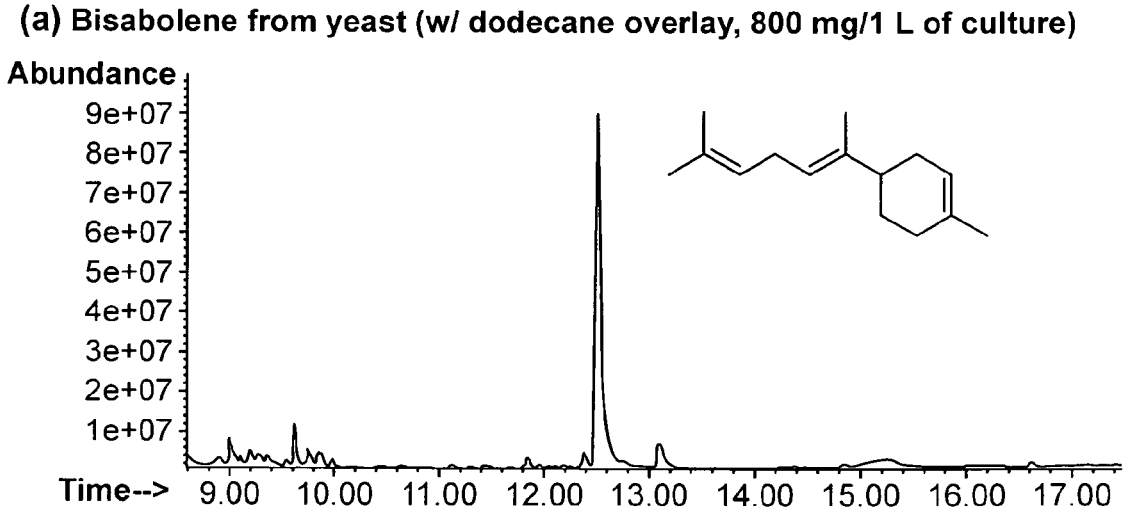
FIG. 5(*a*) provides GC/MS data confirming that the starting material, which was biosynthetically produced, is bisabolene.
Figure 5:
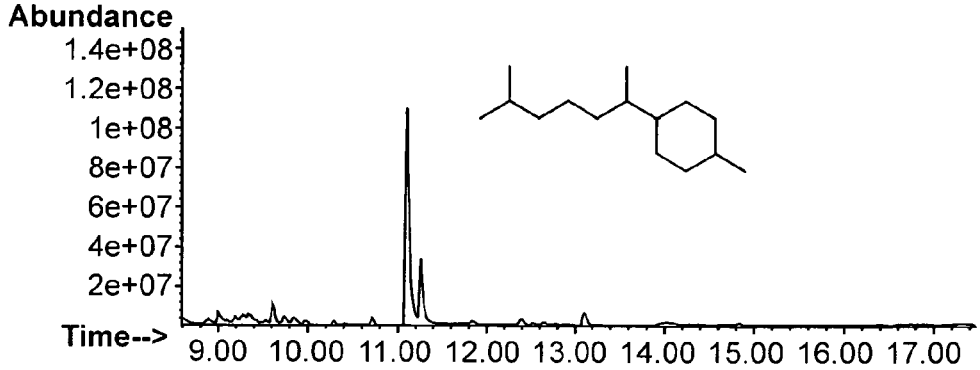
Figure 5:
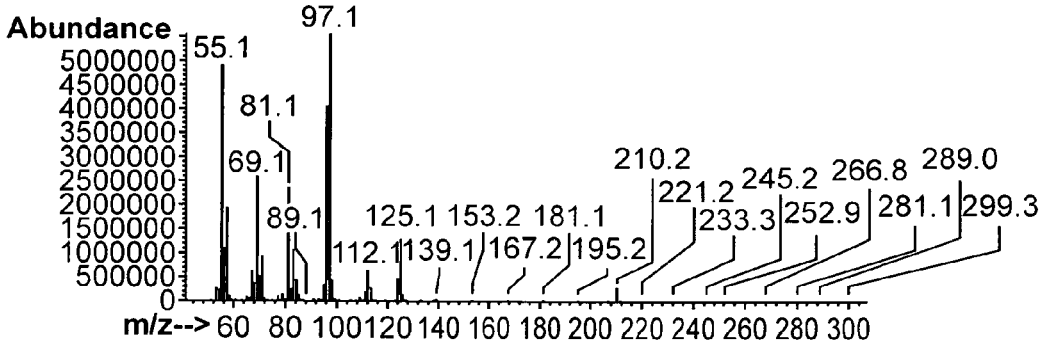
Figure 5:
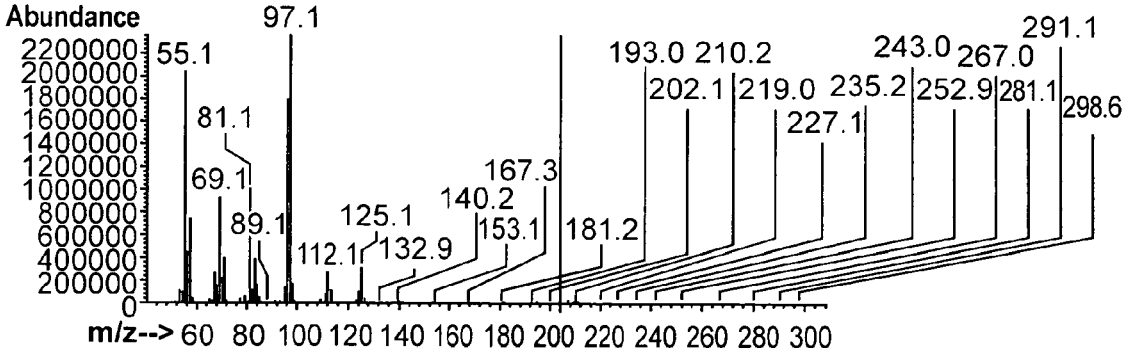

To a reaction vessel, biosynthesized bisabolene and 10% Pd/C catalyst [palladium, 10 wt. % on activated carbon] were added (see, FIG. 4). The vessel was sealed and purged with nitrogen gas, then evacuated under vacuum. To begin the reaction, the vessel was stirred while adding compressed hydrogen gas at 75 barr, recharged (×4). The mildly exothermic reaction was carried out at room temperature. Final conversion was about 100% marked by end of hydrogen consumption and verified by gas chromatography with flame ionization detection. The product-catalyst mixture was separated by gravity filtration through a 60 Å silica gel. GC/MS analysis was performed to confirm that the starting material was bisabolene and, further, to confirm that the resulting product is hydrogenated bisabolene (see, FIG. 4 and FIGS. 5(*a*) and 5(*b*)).

Example 3

Analysis of the Fuel Properties of Hydrogenated Bisabolene

Fuel property testing of hydrogenated bisabolene was carried out using standard ASTM methods known to and used by those of skill in the art. Table 1 sets forth the various fuel properties analyzed for each of Diesel Fuel Grade #2, bisabolene (mixture of isomers) and hydrogenated bisabolene as well as the ASTM test methods employed to analyze the particular fuel property. It can be seen from Table 1 that hydrogenated bisabolene has fuel properties comparable to commercial diesel fuel Grade #2 and, therefore, it is clear that hydrogenated bisabolene fuel compositions of the present invention can advantageously be used as an alternative to diesel fuel and jet fuel as well.

TABLE 1

| Property | Units | ASTM Test method | min or max[a] | Diesel Grade # 2 | Bisabolene (mixture of isomers) | Hydrogenated commercial bisabolene | Hydrogenated biosynthetic bisabolene |
|---|---|---|---|---|---|---|---|
| Density (@ 15.56° C.) | kg/m$^3$ | D4052 | | 864.6 | 859[b] | 819.7 | n/a |
| API Gravity (@ 15.56° C.) | | D4052 | | 32.2 | n/a | 41 | n/a |
| Flash point | ° C. | D93 | min 52 | 73 | 110[b] | 111 | n/a |
| Distillation | ° C. | D2887 | 282-338 | 308[c] | 277[b,d] | 267[d] | n/a |
| Kinetic viscosity (@ 40° C.) | mm$^2$/s | D445 | 1.9-4.1 | 2.44 | n/a | 2.91 | n/a |
| Freeze point | ° C. | D5972 | | n/a | | <−81 | n/a |
| Cloud point | ° C. | D5773 | | −21[e] | | <−78 | n/a |
| Cetane number | | D6890 | min 40 | 41.6[f] | 30.4 | 41.9 | 52.6 |

[a]Reported in EMA (Engine Manufactures Association) Recommended Guideline on Diesel Fuel
[b]Reported in NIST Chemistry WebBook (http://webbook.nist.gov) and The Good Scents Company (http://www.thegoodscentscompany-.com)
[c]Test method by ASTM D86
[d]According to D975-09b, when a cloud point less than −12° C. is specified, the minimum 90% recovered temperature shall be waived
[e]Test method by ASTM D2500
[f]Test method by ASTM D613. Cetane numbers in the range of 40-55 have been measured for D2 diesel.

It is to be understood that the above description is intended to be illustrative and not restrictive. Many embodiments will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications, patents, PCT publications, and Genbank Accession Nos., are incorporated herein by reference for all purposes.

What is claimed is:

1. A fuel composition, said fuel composition comprising:

(a) a hydrogenation product of a monocyclic sesquiterpene comprising a cyclohexene moiety and a branched alkene moiety; and (b) a fuel additive, wherein the hydrogenation product comprises a bisabolane compound of Formula I:

(I)

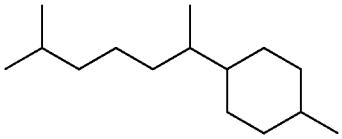

or a stereoisomer thereof.

2. The fuel composition in accordance with claim 1, wherein said monocyclic sesquiterpene is a member selected from the group consisting of α-zingiberene, β-sesquiphellandrene, α-bisabolene, β-bisabolene, γ-bisabolene, curcumene, gossonorol and mixtures thereof.

3. The fuel composition in accordance with claim 2, wherein said monocyclic sesquiterpene is α-zingiberene, α-bisabolene, β-bisabolene, γ-bisabolene, curcumene and mixtures thereof.

4. The fuel composition in accordance with claim 2, wherein said monocyclic sesquiterpene is α-bisabolene or α-zingiberene.

5. The fuel composition in accordance with claim 2, wherein said monocyclic sesquiterpene is a mixture of α-bisabolene and α-zingiberene.

6. The fuel composition in accordance with claim 1, wherein the fuel additive is at least one additive selected from the group consisting of an antioxidant, a cetane improver, a stabilizer, a lubricity improver and combinations thereof.

7. The fuel composition in accordance with claim 1, wherein the fuel composition further comprises a conventional fuel component.

8. The fuel composition in accordance with claim 7, wherein the conventional fuel component is a petroleum-based fuel.

9. The fuel composition in accordance with claim 8, wherein the petroleum-based fuel is a member selected from the group consisting of kerosene, Jet A, Jet A-1, Jet B and combinations thereof.

10. The fuel composition in accordance with claim 7, wherein the conventional fuel component is a petrodiesel or a Fischer-Tropsch-based fuel.

11. The fuel composition in accordance with claim 1, wherein said fuel additive is selected from the group consisting of an antioxidant, an oxygenate, a thermal stability improver, a stabilizer, a cold flow improver, a combustion improver, an anti-foam additive, an anti-haze additive, a corrosion inhibitor, a lubricity improver, an icing inhibitor, an injector cleanliness additive, a smoke suppressant, a drag reducing additive, a metal deactivator, a dispersant, a detergent, a de-emulsifier, a dye, a marker, a static dissipater, a biocide, a cetane improver and combinations thereof; or said fuel additive is at least one additive selected from the group consisting of an antioxidant, a cetane improver, a stabilizer, a lubricity improver and combinations thereof.

12. A vehicle comprising an internal combustion engine, a fuel tank connected to the internal combustion engine, and a fuel composition in the fuel tank, wherein the fuel composition is the fuel composition of claim 1, wherein the fuel combustion is used to power the internal combustion engine.

13. A method of powering an engine comprising the step of combusting the fuel composition of claim 1 in the engine.

14. The method of claim 13, wherein, the engine is a diesel engine.

15. The method of claim 13, wherein the engine is a jet engine.

16. The fuel composition of claim 1, wherein the hydrogenation product comprises a bisabolane compound of Formula I:

(I)

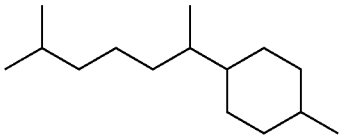

and stereoisomers thereof.

17. The fuel composition in accordance with claim 16, wherein the bisabolane compound is produced by chemically converting a monocyclic sesquiterpene starting material from a biological source to the bisabolane compound of Formula I.

18. The fuel composition in accordance with claim 16, wherein the fuel additive is at least one additive selected from the group consisting of an antioxidant, a cetane improver, a stabilizer, a lubricity improver and combinations thereof.

19. A method of making a fuel composition, said method comprising adding a fuel additive to a hydrogenation product of a monocyclic sesquiterpene comprising a cyclohexene moiety and a branched alkene moiety, wherein the hydrogenation product comprises a bisabolane compound of Formula I:

(I)

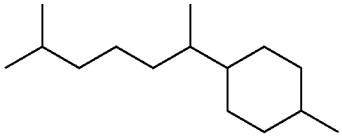

or a stereoisomer thereof.

20. The method in accordance with claim 19, wherein said monocyclic sesquiterpene is a member selected from the group consisting of α-zingiberene, β-sesquiphellandrene, α-bisabolene, β-bisabolene, γ-bisabolene, curcumene, gossonorol and mixtures thereof.

21. The method in accordance with claim 20, wherein said monocyclic sesquiterpene is α-zingiberene, α-bisabolene, β-bisabolene, γ-bisabolene, curcumene and mixtures thereof.

22. The method in accordance with claim 21, wherein said monocyclic sesquiterpene is α-bisabolene or α-zingiberene.

23. The method in accordance with claim 21, wherein said monocyclic sesquiterpene is a mixture of α-bisabolene and α-zingiberene.

24. A method of making a fuel component, said method comprising: hydrogenating a monocyclic sesquiterpene, and recovering the hydrogenation product to produce the fuel component, wherein said monocyclic sesquiterpene is a member selected from the group consisting of α-zingiberene, β-sesquiphellandrene, α-bisabolene, β-bisabolene, γ-bisabolene, curcumene, gossonorol and mixtures thereof.

* * * * *